US006409325B1

(12) United States Patent
Matsumoto et al.

(10) Patent No.: US 6,409,325 B1
(45) **Date of Patent: *Jun. 25, 2002**

(54) INK-JET CARTRIDGE AND METHOD OF STORING PRINT HEAD

(75) Inventors: Toshiya Matsumoto, Yokohama; Masataka Eida, Kawasaki, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/022,551

(22) Filed: Feb. 12, 1998

(30) Foreign Application Priority Data

Feb. 14, 1997 (JP) ..... 9-030685

(51) Int. Cl.[7] ..... B41J 2/175; B41J 2/165
(52) U.S. Cl. ..... 347/87; 347/29
(58) Field of Search ..... 347/87, 22, 29, 347/31, 84, 85, 86

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,506,277 A | | 3/1985 | Terasawa | |
| 4,538,160 A | | 8/1985 | Uchiyama | |
| 4,558,333 A | | 12/1985 | Sugitani et al. | |
| 4,599,627 A | | 7/1986 | Vollert | |
| 4,723,129 A | | 2/1988 | Endo et al. | |
| 4,740,796 A | | 4/1988 | Endo et al. | |
| 5,231,416 A | * | 7/1993 | Terasawa et al. | 347/23 |
| 5,424,768 A | * | 6/1995 | Dudek et al. | 347/29 |
| 5,467,118 A | | 11/1995 | Gragg et al. | 347/87 |
| 5,648,802 A | * | 7/1997 | Abe | 347/29 |
| 5,667,063 A | * | 9/1997 | Abe | 206/204 |
| 5,812,166 A | * | 9/1998 | Yamazaki | 347/87 |
| 5,850,238 A | * | 12/1998 | Karita et al. | 347/29 |
| 5,917,514 A | * | 6/1999 | Higuma et al. | 347/29 |
| 5,917,525 A | * | 6/1999 | Butty | 347/86 |
| 5,940,104 A | * | 8/1999 | Karita et al | 347/87 |
| 6,062,390 A | * | 5/2000 | Nakamura | 206/576 |
| 6,097,407 A | * | 8/2000 | Terasawa et al. | 347/31 |
| 6,336,698 B1 | * | 1/2002 | Imai | 347/32 |

FOREIGN PATENT DOCUMENTS

| | | |
|---|---|---|
| EP | 514 632 | 11/1992 |
| EP | 559 206 | 9/1993 |
| EP | 671 273 | 9/1995 |
| EP | 741 038 | 11/1996 |
| JP | 53-24486 | 3/1978 |
| JP | 54-43733 | 4/1979 |
| JP | 56-84992 | 7/1981 |
| JP | 59-123670 | 7/1984 |
| JP | 59-138461 | 8/1984 |
| JP | 62-38155 | 8/1987 |
| JP | 64-63185 | 3/1989 |
| JP | 5-202328 | 8/1993 |

* cited by examiner

*Primary Examiner*—Judy Nguyen
(74) *Attorney, Agent, or Firm*—Fitzpatrick, Cella, Harper & Scinto

(57) ABSTRACT

In a print head which can be mounted in a printer and which has a first ejection portion to eject an ink and a second ejection portion to eject a print performance improving liquid to aggregate or make insoluble the ejected ink, the storage method effectively prevents the mixing of the ink and the print performance improving liquid if one or both of these liquids should leak before the print head is mounted in the printer. The seal member having an opening and adapted to seal the first and second ejection portions so that its opening is located between these ejection portions is removably bonded to the print head. This arrangement closes the ejection portions with the protective tape, preventing leakage of the ink and the print performance improving liquid. If one or both of these liquids should leak, the liquid seeping toward the other ejection portion by capillary action generated at the joint portion between the protective tape and the orifice plate surface can be blocked by the opening of the protective tape that nullifies the capillary action.

31 Claims, 16 Drawing Sheets

INK-JET CARTRIDGE AND METHOD OF STORING PRINT HEAD

This application is based on Patent Application No. 30685/1997 filed Feb. 14, 1997 in Japan, the content of which is incorporated hereinto by reference.

BACKGROUND OF THE INVENTION

1. Field of the Invention

The present invention relates to an ink-jet print head, an ink-jet cartridge and an ink-jet printing apparatus equipped therewith which can produce high quality printed images on a print medium, and more specifically to an ink-jet cartridge and a method of storing a print head which are suitably applied to ink-jet printing that ejects onto a print medium print ink and a print performance improving liquid that makes insoluble or aggregates coloring materials in the print ink.

2. Description of the Related Art

Apparatuses that print (or record) on a print medium (or recording paper), including paper, cloth and plastic sheets such as OHP films, have been proposed to have a construction that can mount a recording head of various systems such as wire dot recording, thermosensitive recording, thermal transfer recording and ink-jet recording.

Of these recording systems, the ink-jet system is one of low-noise non-impact recording systems that eject ink which then directly adheres to the recording paper. The ink-jet system is largely classed, according to the ink droplet forming method and ink ejection energy generation method, into a continuous type (including charged particle control and spray systems) and an on-demand type (including piezo, spark and bubble jet systems).

The continuous type ejects ink continuously and imparts electric charge only to necessary droplets. The charged droplets then adhere to the recording paper and the remaining non-charged droplets are wasted. The on-demand type, on the other hand, delivers ink only when necessary for printing and therefore neither waste ink nor have a risk of contaminating the interior of the printer. The on-demand type, because it starts or stops ink ejection, has lower response frequencies than those of the continuous type. Hence, the on-demand type realizes high-speed printing by increasing the number of nozzles, and most of the recording apparatuses currently on the market are of the on-demand type. Because the recording apparatuses having the recording head of such an ink-jet system are capable of high-density and high-speed recording, they are commercialized and utilized as output means of information processing systems, which include printers as output terminals of copying machines, facsimiles, electronic typewriters, word processors and workstations or handy or portable printers used on personal computers, host computers, optical disk devices and video apparatuses. In this case, the ink-jet recording apparatus will take a configuration that meets particular functions and the conditions of use of these apparatuses.

Generally, the ink-jet recording apparatuses include a carriage mounting a recording means (recording head) and an ink tank, a feeding means to feed recording paper, and a control means to control these components. The recording head that ejects ink droplets from a plurality of nozzles is serially scanned, i.e., moved in a direction (main scan direction) perpendicular to the recording paper feeding direction (sub-scan direction) and at the same time the recording paper is intermittently fed by an amount equal to the recording width of the recording head during the non-recording time. This recording system performs recording by shooting ink droplets onto the recording paper according to recording signals and has found wide use because of its low running cost and low-noise operation. The use of the recording head that has many ink ejection nozzles aligned in the sub-scan direction can perform recording over a width corresponding to the number of nozzles by scanning, the recording head over the recording paper once. This makes it possible to increase the speed of the recording action.

In the case of a color ink-jet recording apparatus, a color image is formed by superimposing ink droplets ejected from multiple color recording heads. To perform color recording in general requires four kinds of recording head and ink cartridge that correspond to three primary colors-yellow (Y), magenta (M) and cyan (C) -or four colors including black (B) in addition to the three primary colors. In recent years, recording apparatuses that mount such three- or four-color recording heads to form full-color images have been commercialized.

The energy generating means in the recording head to produce energy for ejecting ink include one that uses electromechanical transducers such as piezoelectric elements and one that uses electrothermal transducers having heat generating resisters to heat liquid.

The recording head of a system (so-called bubble jet system) that ejects liquid by using thermal energy (which utilizes the film boiling phenomenon) can arrange the liquid nozzles in high density and thus perform high resolution recording.

The process of ejecting ink as performed by the bubble jet type recording head with the above construction will be explained briefly.

When a heat generating resister (heater) reaches a predetermined temperature, a film bubble that covers the heater surface is :formed. This bubble has a very high internal pressure and expels the ink in the nozzle. An inertia force produced by the expelling action forces the ink out of the nozzle and toward a common liquid chamber in the opposite direction. As the ink movement advances, the internal pressure of the bubble becomes negative and, combined with the flow path resistance, slows down a moving speed of the ink. The speed of the ink ejected out of an orifice of the nozzle is faster than that within the nozzle, so that the ink is narrowed by the balance of the inertia force, the flow path resistance, contraction of the bubble and ink surface tension, and a lump of ink outside the orifice is separated into a droplet. Simultaneously with the contraction of the bubble, ink is supplied from the common liquid chamber into the nozzle by a capillary action and stands by for the next pulse.

In this way the recording head that uses the electrothermal transducer as an energy generating means can produce a bubble in the ink in the liquid path in response to and in a one-to-one relation with a drive electric pulse signal and can also produce and contract a bubble instantaneously and properly, realizing ejection of ink droplets with excellent responsiveness. Further, the recording head can be made compact easily by taking full advantage of the IC technology and microfabrication technology in the semiconductor field where the technological advance and reliability improvement in recent years are remarkable. This in turn facilitates high density integration and lowers the manufacturing cost.

There are two types of such recording heads, a permanent type and a detachable type. In the permanent type the recording head has a service life longer than that of the recording apparatus and is so constructed that it is normally not removed from the apparatus itself. The detachable type, on the other hand, has a detachable head cartridge (also called an ink cartridge) in which a recording head and an ink tank are assembled together. When ink in the head cartridge runs out, the head cartridge is taken out of the apparatus body for recycling and a new head cartridge is installed.

The ink orifices of the head cartridge are sealed with a seal tape for protection during transport, storage and marketing of the head cartridge and also for preventing leakage or evaporation of ink from the ink orifices and inflow of air.

If the adhesion force of the seal tape is increased for more reliable prevention of ink leakage or evaporation and air inflow, adhesive agent of the seal tape remains on the periphery of the orifices. To avoid this problem, a method is known in which a cap member is installed on a seal tape having weak adhesion to press the seal tape by an elastic body of the cap member against the periphery of the orifices. There are growing demands for the ink-jet recording apparatus as excellent recording means and also for higher quality printed images.

In forming images on a recording medium called plain paper the conventional ink-jet recording apparatus has a problem of insufficient water resistance of the image. Another problem is that, when forming color images, it is difficult to provide images that are highly dense without feathering and bleeding between colors, in other words, color images that have both fastness and high print quality.

As a means to improve water resistance of an image, a method is known which uses ink that a colorant contained in the ink has a water-resistant property. This method has been put into practical use in recent years. The water resistance, however, is not good enough and because the ink is hardly soluble in water after being dried, the orifices of the recording head are easily clogged. Preventing this problem inevitably gives rises to another problem of making the apparatus construction more complex.

Japanese Patent Application Laying-Open No. 84992/1981 discloses a method wherein a material for fixing dyes to recording paper is applied to the recording paper beforehand and a large amount of such treated paper is prepared. With this method, however, it is necessary to use only the particular recording paper prepared beforehand for printing. Further, because the dedicated recording paper coated with a dye fixing material is produced in large amounts beforehand, a large dedicated paper making equipment becomes necessary increasing the overall cost. Moreover, it is difficult to coat the dye fixing material over the paper to a predetermined thickness stably during the process of making the dedicated recording paper.

Japanese Patent Application Laying-Open No. 63185/1989 discloses a technology wherein a colorless ink that makes a dye insoluble is ejected from an ink-jet recording head onto the recording paper.

Japanese Patent Application Laying-Open No. 202328/1993 discloses a technology that forms a water-resistant image without color bleeding by applying a multivalent metallic salt solution followed by an ink containing chemical dye having carboxyl group. When liquid that renders dyes insoluble is ejected from an ink-jet head, however, if the recording ink and the liquid should come into contact within the recording apparatus body, an operational failure of the recording apparatus may result. Any prior art offers no recording apparatus configuration that incorporates measures against such problems.

A number of technologies have been proposed that improve the fastness of printed images on a recording medium.

Japanese Patent Application Laying-Open No. 24486/1978 discloses a technique that transforms dyes into lake and fixes them on a dyeing medium by post-processing the dyeing medium to enhance their wet fastness.

Japanese Patent Application Laying-Open No. 43733/1979 in particular discloses a recording method that uses the ink-jet recording system and applies two or more ingredients that promote a film forming performance at normal or elevated temperatures when the ingredients contact. In a printed matter printed with this method, a film firmly adhering to the recording medium is formed as the ingredients contact each other on the recording medium.

Japanese Patent Application Laying-Open No. 150396/1980 (Japanese Patent Application Publication No. 38155/1987), too, discloses a method of applying a water-resisting agent that forms lake of dye after performing the ink-jet recording using aqueous dye ink.

U.S. Pat. No. 4,538,160 discloses an ink-jet recording method which identifies beforehand an image position where recording is to be made and shoots onto the same identified position a recording ink and a process ink for improving the quality and durability of a dot. Among other methods disclosed in this patent are one that describes an image using the process ink before applying the recording ink, one that superimposes the process ink on the image that has been described using the recording ink, and one that shoots the recording ink onto the pattern that has been described with the process ink and then applies the process ink again overlapping the described image.

On the other hand, in an ink-jet recording system, because the recording head ejects ink droplets onto a recording medium such as paper or OHP film, fine ink particles or mist other than the main ink droplets and splashes produced when the ink lands on the recording medium will adhere to that part of the recording head where the orifices are formed, accumulating solidified ink around the orifices. Further, foreign matters such as paper dust may stick to the accumulated ink. These will interfere with the ink ejection, causing such troubles as ink droplets being ejected in unexpected directions or failing to be shot out.

When a recording head, after being mounted in a printing apparatus, is left in a non-recording state where it does not eject ink for a long period, ink in the orifices will evaporate, increasing its viscosity or become dry or solidified, clogging the orifices, which in turn will result in a random-direction ejection or a failure to eject. Thus, the ink-jet recording apparatus is provided with a recovery means to eliminate these problems.

The recovery means commonly uses a wiping structure, which wipes an orifice-formed surface with a blade formed of an elastic member such as rubber to remove from the orifice-formed surface unwanted ink that was formed by accumulating mist and by the ink splashes from the recording medium and also remove foreign matters such as paper dust.

In the head cartridge having a head which ejects a print performance improving liquid that makes dyes (colorants) in the ink insoluble or aggregate, when an ink or a print performance improving liquid should leak from the orifices during transport, storage or marketing, or when ink mist other than the main ink droplets ejected during printing and ink splashes from the recording medium are produced in large amounts, or when inadequate recovery operation or wiping operation is performed, the ink and the print performance improving liquid will come into contact with each other on the orifice-formed surface of the head, causing the colorants (dyes) to become insoluble or aggregate near the orifices and foreign matters such as paper dust to stick to the colorants. These may hinder the ink ejection, giving rise to a risk of the ink droplets flying in random directions or failing to be ejected.

As to the above-mentioned troubles arising from the mixing of the ink and the liquid that makes ink insoluble or as to the construction to eliminate such troubles, no description or even suggestion is found in the above conventional arts.

SUMMARY OF THE INVENTION

The present invention has been accomplished to solve these problems and its object is to keep the dyes (colorants) from becoming insoluble or aggregating around the orifices of the head and thereby maintain high print quality even if the ink and the print performance improving liquid should leak from the orifices during transport, storage, marketing or use.

In a first aspect of the present invention, there is provided an ink-jet cartridge, comprising:

a print head portion having a first ejection portion to eject print ink and a second ejection portion to eject liquid containing print performance improving liquid to improve the print performance of the print ink ejected from the first ejection portion, the print head portion being able to be mounted in an ink-jet print apparatus; and a seal member removably bonded to the print head portion and having an opening, the seal member closing the first ejection portion and the second ejection portion with the opening located between the first and second ejection portions.

In a second aspect of the present invention, there is provided an ink-jet cartridge, comprising:

a print head portion having a first ejection portion to eject print ink and a second ejection portion to eject liquid containing print performance improving liquid to improve the print performance of the print ink ejected from the first ejection portion, the print head portion being able to be mounted in an ink-jet print apparatus; and an ejection portion pressing member removably mounted on the print head portion, the ejection portion pressing member having first and second elastic members, the first and second elastic members forming independent pressing surfaces to press the first and second ejection portions, respectively.

In a third aspect of the present invention, there is provided a method of storing a print head having a first ejection portion to eject print ink and a second ejection portion to eject liquid containing print performance improving liquid to improve the print performance of the print ink ejected from the first ejection portion, the print head being able to be mounted in an ink-jet print apparatus, comprising the step of:

hermetically closing the first and second ejection portions with first and second elastic members of a ejection portion pressing member, the first and second elastic members having independent pressing surfaces.

Here, the ejection portion pressing member may press the first and second ejection portions through a seal member that closes the first and second ejection portions.

The seal member may have an opening between a portion closing the first ejection portion and a portion closing the second ejection portion.

The first and second elastic members may be formed of a porous body.

A pressing surface of at least one of the first and second elastic members may have a smooth skin layer.

A pressing force of the second elastic member may be greater than a pressing force of the first elastic member.

A dimension of the second elastic member in a pressing direction may be set larger than a dimension of the first elastic member in the pressing direction to differentiate pressing forces of the first elastic member and the second elastic member.

The second elastic member may use a material with a higher hardness than that of a material of the first elastic member to differentiate pressing forces of the first elastic member and the second elastic member.

A rib may be provided between the first elastic member and the second elastic member, the rib having a height lower than the heights of the first and second elastic members when elastically deformed.

The second elastic member may be made of a material with excellent acid resistance.

The ejection portion pressing member may have a holding member that holds the first and second elastic members and keeps the first and second elastic members in an elastically deformed state produced by a pressing action, and the holding member may be provided with means, at a position between the first and second elastic members, for preventing liquid from at least one of the first and second ejection portions reaching the other ejection portion.

The reach preventing means may comprise a rib to isolate the first and second elastic members from each other.

The reach preventing means may comprise a groove or a finely roughened surface formed on the holding member between the first and second elastic members.

The reach preventing means may comprise a liquid-repellent surface applied on the holding member between the first and second elastic members.

The reach preventing means may comprise a liquid-absorbent member provided on the holding member between the first and second elastic member.

The above and other objects, effects, features and advantages of the present invention will become apparent from the following description of embodiments thereof taken in conjunction with the accompanying drawings.

DETAILED DESCRIPTION OF PREFERRED EMBODIMENTS

The present invention will now be described in detail by referring to the accompanying drawings.

(Embodiment 1)

Figure 1A:
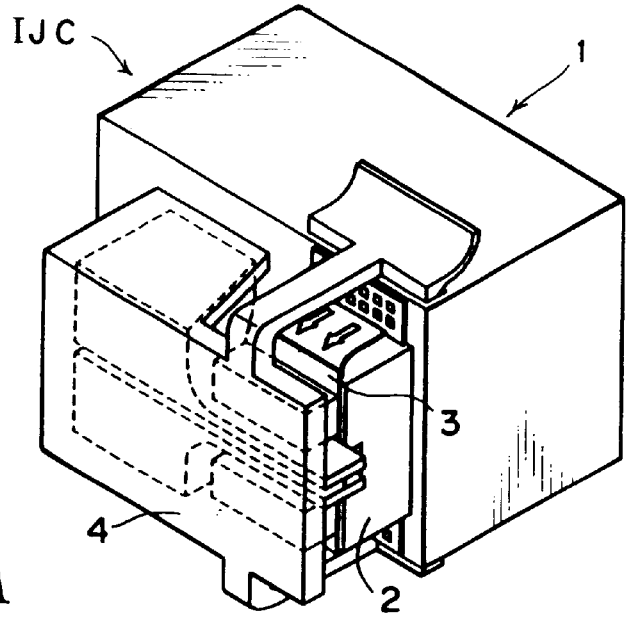
FIGS. 1A and 1B illustrate an example configuration of an ink-jet cartridge of the first embodiment, FIG. 1A representing an overall perspective view and FIG. 1B representing an exploded perspective view.
Figure 1B:
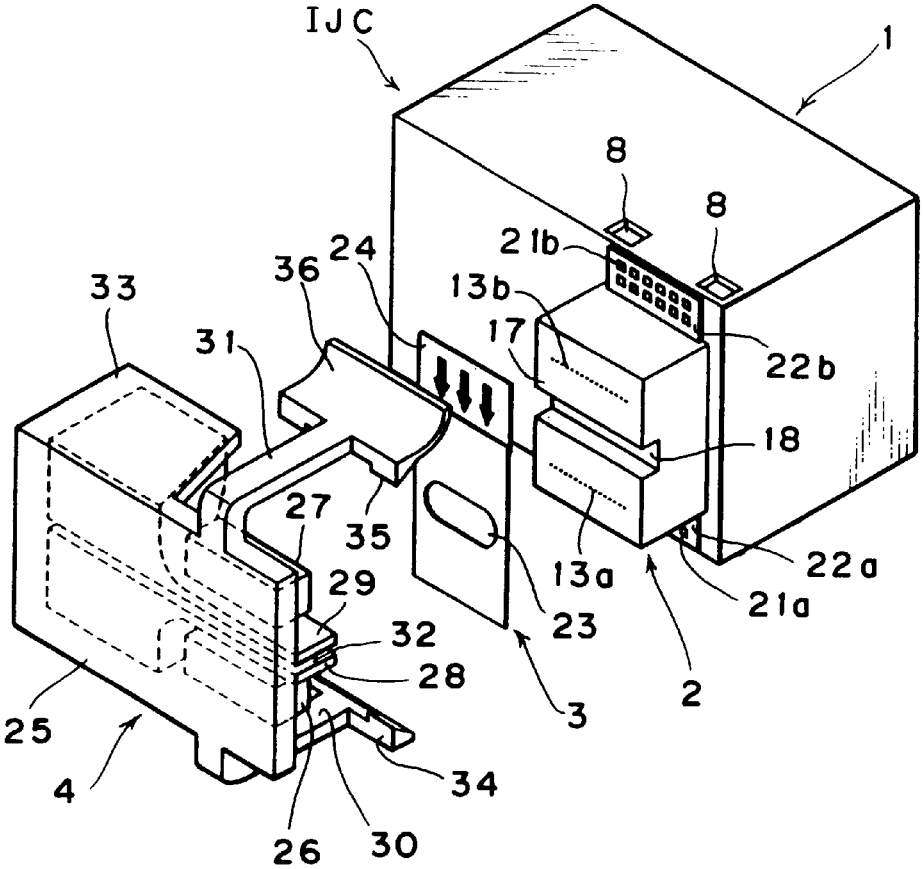
Figure 2:
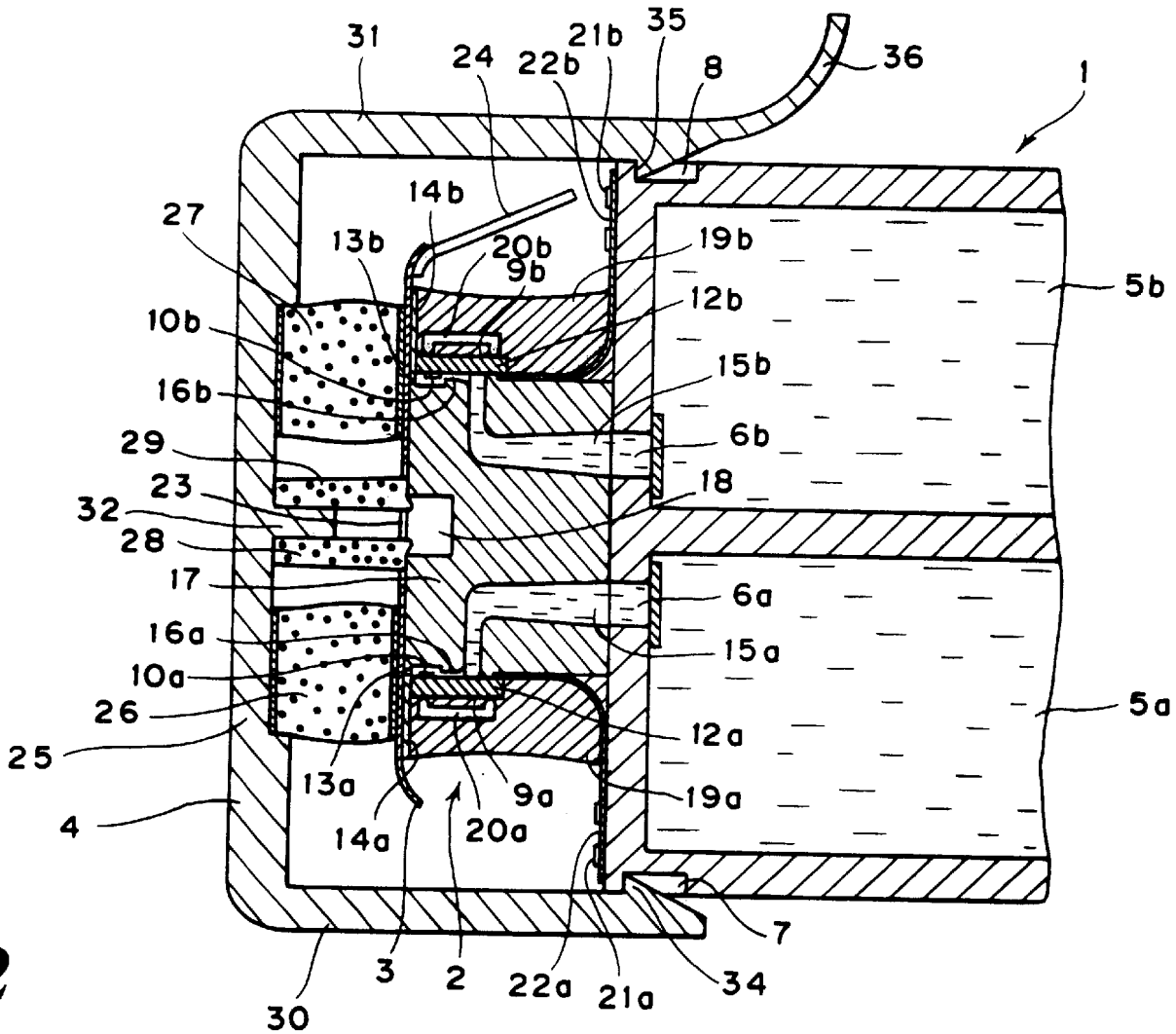
FIG. 2 is a partial cross section of the ink-jet cartridge of the first embodiment.
Figure 3:
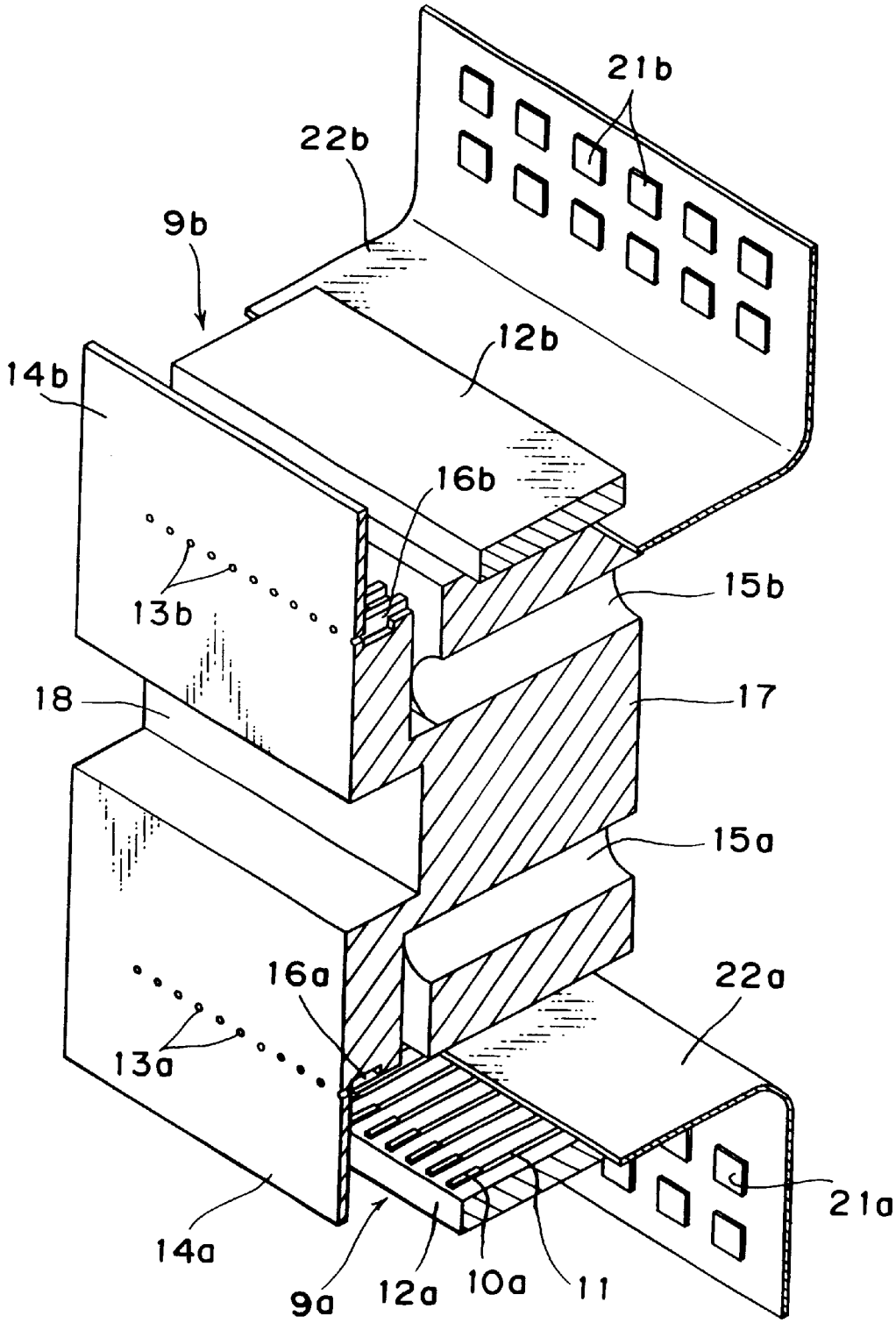
FIG. 3 is a perspective view schematically showing a print head of the ink-jet cartridge of the first embodiment.
Figure 4:
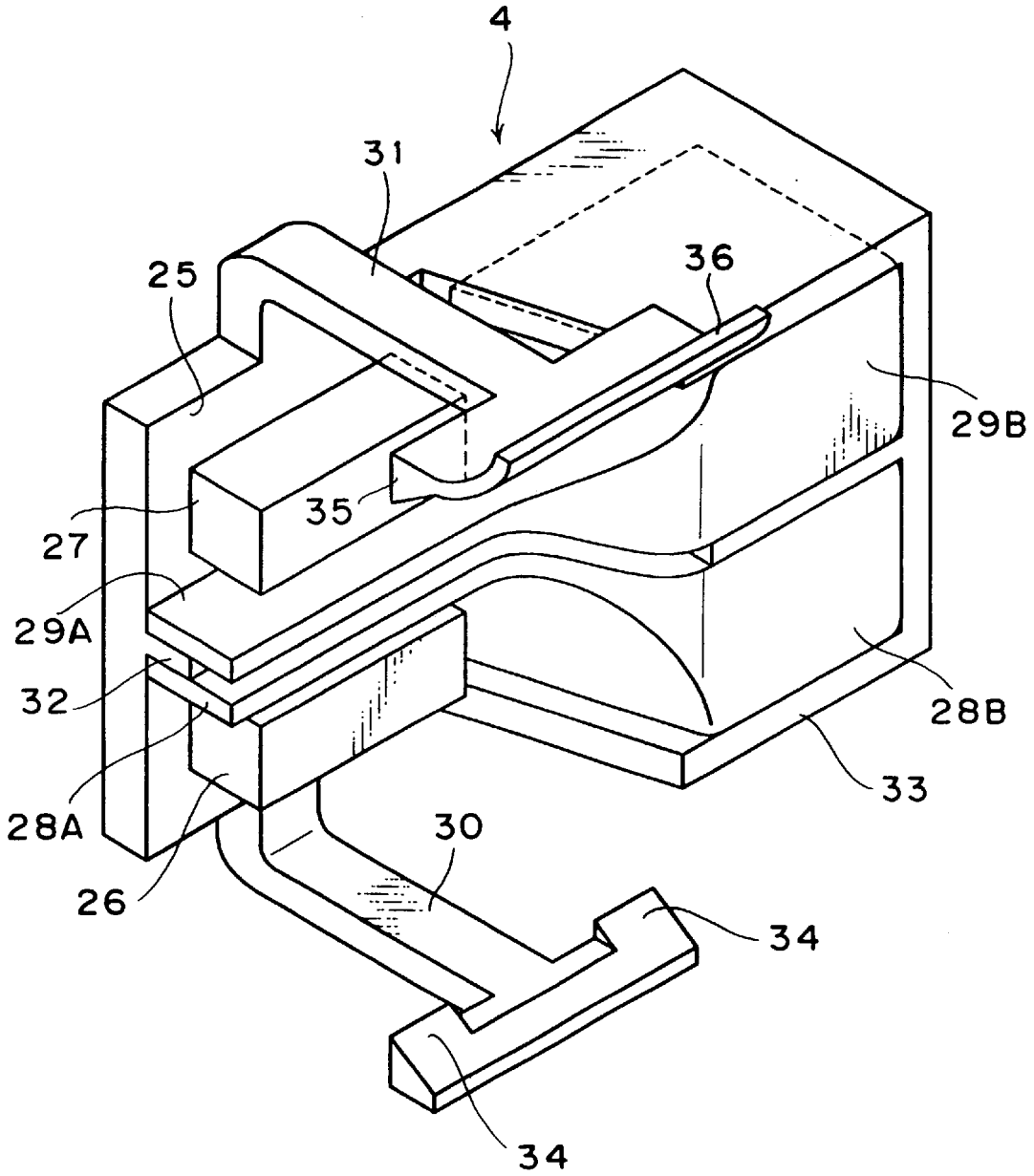
FIG. 4 is a perspective view of a protective cap of the ink-jet cartridge of the first embodiment.

FIGS. 1 to 4 show an example configuration of the ink-jet cartridge as the first embodiment of this invention. FIGS. 1A and 1B are an overall perspective view and an exploded perspective view, respectively, FIG. 2 is a partial cross section, and FIG. 3 and FIG. 4 are perspective views of parts of FIGS. 1A and 1B.

In FIGS. 1A and 1B, IJC represents an entire ink-jet cartridge removably mountable on a printer body described later with reference to FIG. 5. The ink-jet cartridge includes a tank portion 1, a print head portion 2, a protective tape 3 as a removable sealing member, and a protective cap 4 as an ink ejection portion pressing member, these members being formed substantially vertically symmetrical.

The tank portion 1, as shown in FIG. 2, is divided into two chambers, each accommodating an absorbent body 5*a* or 5*b* made of a porous material such as sponge. One absorbent body (5*a* for example) is impregnated with an ink as a printing agent and the other absorbent body (5*b*) with a liquid (print performance improving liquid) to improve the print performance. The ink and the print performance improving liquid are supplied to the print head portion 2 through supply ports 6*a*, 6*b* provided in each chamber. The tank portion 1 is formed with grooves 7, 8 on its outer side near the print head.

The print head portion 2 has a head chip 9*a* to eject the print ink and a head chip 9*b* to eject the print performance improving liquid. These head chips 9*a*, 9*b* have virtually similar constructions and, as shown in FIG. 3, include electrothermal transducers 10*a*, 10*b* to generate thermal energy for ejecting the ink and the print performance improving liquid, substrates 12*a*, 12*b* formed with electrodes 11*a*, 11*b* and drive elements (not shown), and orifice-formed members (hereinafter referred to as orifice plates) 14*a*, 14*b* formed with a predetermined number of orifices 13*a*, 13*b* at predetermined pitches.

In this embodiment, the following three parts are integrally formed in a common top plate or block for the head chips 9*a*, 9*b*. The three parts are the orifice plates 14*a*, 14*b*; portions which have grooves communicating with the orifices and forming liquid passages 16*a*, 16*b* at portions corresponding to the electrothermal transducers 10*a*, 10*b* and which are joined to the substrates 12*a*, 12*b*; and supply tubes 15*a*, 15*b* to introduce the ink and the print performance improving liquid from the tank portion 1. That is, this embodiment uses a top plate 17 that is integrally formed with the supply tubes for the print ink and the print performance improving liquid, the liquid passage forming grooves and the orifice plates. The orifices 13*a*, 13*b* are arranged virtually parallelly on the orifice plates 14*a*, 14*b* that are almost planar portions of the top plate 17 facing the print medium. The top plate 17 has a liquid reservoir groove 18 formed between the orifice plates 14*a*, 14*b* in a direction almost parallel to the direction in which the orifices 13*a*, 13*b* are arranged.

The print head portion 2 is assembled by mounting, from both sides, the substrates 12*a*, 12*b* of the head chips 9*a*, 9*b* on the liquid passages 16*a*, 16*b* that are parallelly formed on both sides of the top plate 17, by fixing the substrates 12*a*, 12*b* with retainer springs 20*a*, 20*b* and by sealing them with sealing materials 19*a*, 19*b*. The head chips 9*a*, 9*b* are attached with flexible printed circuit boards 22*a*, 22*b* that have contacts 21*a*, 21*b* for electrical connection with the printer body.

As described above, the tank portion 1 and the print head portion 2 have their interiors completely divided into two systems, one for the print ink and one for the print performance improving liquid. The constructions for these two systems are virtually equal except for the kinds of liquids used and stored.

The protective tape 3 and the protective cap 4 protect the print head portion 2 and seal the print ink orifices 13*a* and the print performance improving liquid orifices 13*b*. They can be dismounted as shown in FIG. 1B just before the ink-jet cartridge is mounted in the printer body. The protective tape 3 has a virtually oval opening 23 at almost the center, on both sides of which the protective tape 3 seals the print ink orifices 13*a* and the print performance improving liquid orifices 13*b*. The protective tape 3 is bonded with a tab 24 that facilitates the removal of the tape.

The protective cap 4, as also shown in FIG. 4, generally comprises a base member 25, two elastic bodies 26, 27, and two absorbent bodies 28, 29. The base member 25 is integrally formed with two arm portions 30, 31 opposing vertically to each other to wrap around the print head portion 2; a rib 32 extending on the inner side of the base member 25 in the orifice arrangement direction; and a wall 33 generally shaped like a letter U to enclose an end of the base member. The arm portions 30, 31 have claws 34, 35 projecting inwardly from the free end part thereof. At the terminal end of the arm portion 31 is formed a flange 36 to facilitate the removal of the cap.

The two elastic bodies 26, 27 are substantially square columns longer than the range where the orifices 13*a*, 13*b* are arranged. The two absorbent bodies 28, 29 have symmetrical shapes, each having a liquid introducing portion 28A, 29A and a reservoir portion 28B, 29B. These two elastic bodies 26, 27 and two absorbent bodies 28, 29 are arranged on both sides of the rib 32 on the inner side of the base member 25. That is, arranged from bottom to top of the figure are the elastic body 26, the absorbent body 28, the rib 32, the absorbent body 29, and the elastic body 27, all secured to the base member 25. The elastic bodies 26, 27 and the absorbent bodies 28, 29 are kept out of contact and spaced a predetermined interval. The shapes and dimensions of these members are properly determined so as to be able to perform the following functions.

The state in which the above ink-jet cartridge is attached with the protective tape 3 and the protective cap 4 is briefly explained. The protective cap 4 is mounted by engaging its claws 34, 35 with the grooves 7, 8. When the protective cap 4 is mounted, the elastic bodies 26, 27 and the absorbent bodies 28, 29 are clamped between the base member 25 and the print head portion 2 and elastically deformed. As a result, the elastic bodies 26, 27 presses the protective tape 3 against the orifice plates 14*a*, 14*b* thus sealing all the orifices 13*a*, 13*b*. The width of the opening 23 of the protective tape 3 is greater than the width of the liquid reservoir groove 18 of the top plate 17. The liquid introducing portions 28A, 29A of the absorbent bodies 28, 29 engage the boundary portion of the liquid reservoir groove 18 inside the opening 23. The reservoir portions 28B, 29B of the absorbent bodies 28, 29 are installed in a space that avoids the print head portion 2. The tab 24 of the protective tape 3 is situated in a space between the print head portion 2 and the arm portion 31 of the protective cap 4.

Next, the main part of this embodiment will be explained in detail.

The performances required of at least one of the elastic bodies 26, 27 are that their compression residual strains are small, that they do not degrade or contaminate the constituent material of the print head portion 2, the print ink and the print performance improving liquid, that they are not degraded or contaminated by these, and that because they close the fine orifices, their pressing surfaces need to be smooth. If a simple porous body is used, a sufficient pressing state may not be obtained because of the presence of pores larger than the orifices in the pressing surface. Thus, in this embodiment at least one of the elastic bodies 26, 27 uses a high-density microurethane foam (for example, Polon LE20 of Inoac Co. make) about 6 mm thick-a porous body having a smooth skin layer on the surface that meets the above requirements.

The protective tape 3 may be formed of a flexible sheet about 10–40 $\mu$m thick, such as polyethylene terephthalate and, polypropylene, polytetrafluoroethylene, and an acrylic adhesive material about 10–40 $\mu$m thick. The print performance improving liquid is a liquid containing a compound that makes insoluble or aggregates colorants such as dyes or pigments in the ink, or makes insoluble and aggregates coloarants. In more concrete terms, a water solution of cation-based polymer is used. For the print ink, a common ink containing acid dye is used. It is noted that this invention is not limited to the above examples as long as the constructions and materials do not deviate from the scope of this invention.

With the ink-jet cartridge of the above configuration, the orifices are closed by the protective tape 3 which is kept attached (during transport, storage and marketing) until the cartridge begins to be used, preventing leakage of the ink and the print performance improving liquid. In the event that the ink or the print performance improving liquid or both should leak, the liquid seeping gradually toward the other orifice group by capillary action generated at the joint portion between the protective tape 3 and the orifice plate surface can be blocked by the opening 23 formed in the protective tape 3 that nullifies the capillary action.

Further, the elastic bodies 26, 27 provided in the protective cap 4 that press against the orifices prevent leakage of the ink and the print performance improving liquid. If at least one of the liquids should leak, the liquid seeping toward the other orifice group by capillary action generated between the elastic body and the orifice plate surface (including capillary action generated at the contact surface of the protective tape 3 when the protective tape 3 is interposed as in this embodiment) can be blocked by forming independent pressing surfaces of the elastic bodies at each orifice group to cut off the capillary action. Further, because the rib 32, the absorbent bodies 28, 29 and the liquid reservoir groove 18 are arranged between these elastic bodies, the liquid seeping toward the other group of orifices can be stopped by the reservoir or by the extension of the surface distance that the seeping liquid must travel before it can reach the other orifice group.

Next, an example of the ink-jet cartridge of the above construction mounted in the printer body will be explained.

Figure 5:
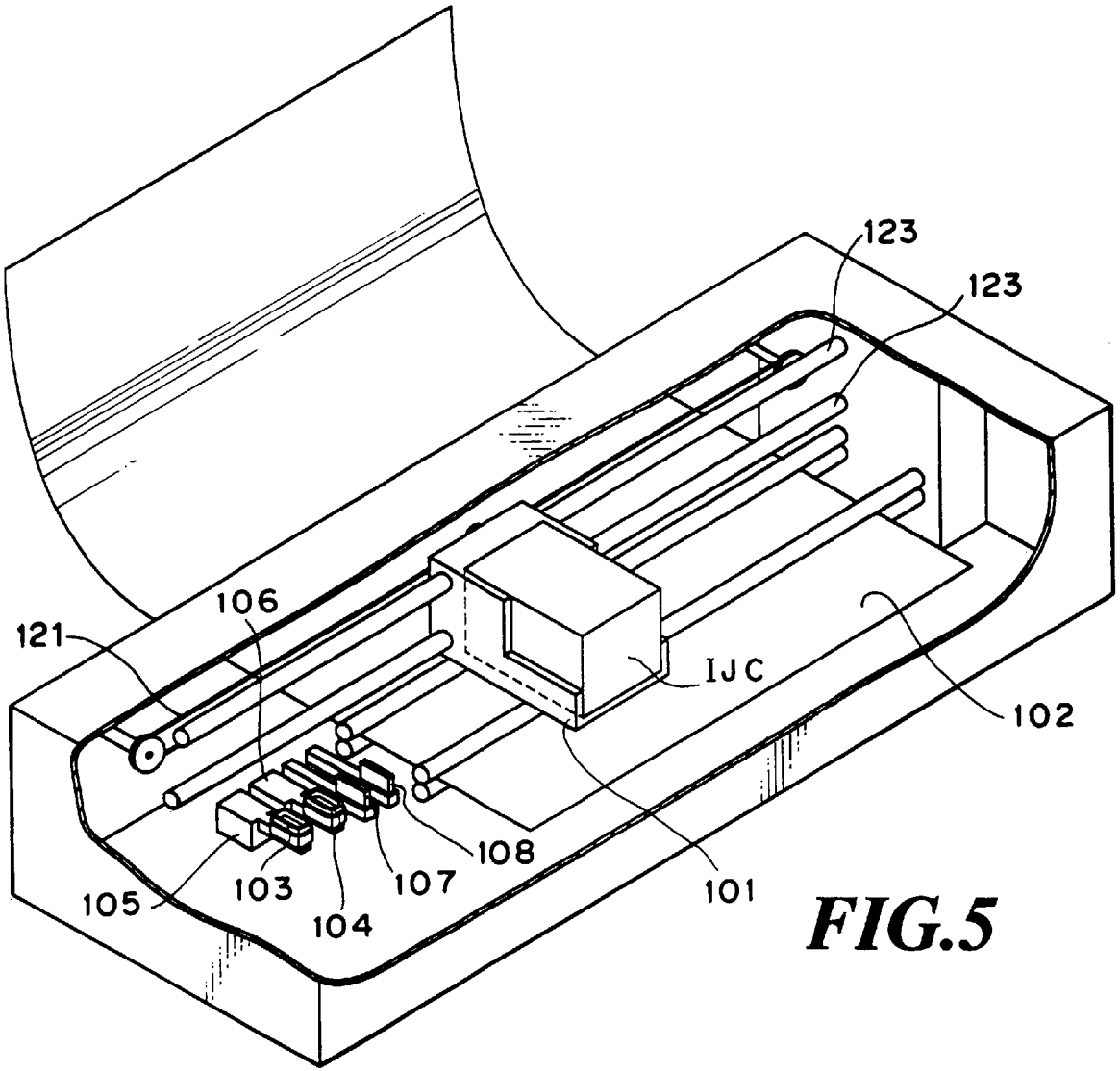
FIG. 5 is a perspective view schematically showing a printer that can mount the ink-jet cartridge of the first embodiment.

FIG. 5 shows an outline configuration of the printer body that mounts the ink-jet cartridge described above. When the ink-jet cartridge IJC is mounted on the carriage 101 in the printer body, the contacts 21*a*, 21*b* of the ink-jet cartridge IJC come into contact with contacts (hot shown) at predetermined positions on the carriage 101 and the ink-jet cartridge IJC now can receive drive signals from the printer body. In performing the print operation, the ink-jet cartridge IJC is moved along guide rails 123 in lateral directions (directions different from the orifice arrangement direction; for example, directions perpendicular to the orifice arrangement direction) together with the carriage 101 secured to a belt 121 connected to a drive source (not shown) by the driving action of the drive source. While being moved, the ink-jet cartridge IJC ejects the print ink and the print performance improving liquid from the orifices 13*a*, 13*b* in response to the drive signals received.

Then, both of the liquids are brought into contact with each other on the print medium 102 to form print dots and improve the print performance as by imparting water resistance to the dyes in the ink. That is, when the dyes in the ink react with the print performance improving liquid on the print medium 102, they instantly become insoluble and/or aggregate. Not only does this improve the water resistance but it also prevents undesired bleeding between different tones when inks of different tones (including shades) are used. The improvement of print performance mentioned here includes improvements of at least one of elements that are desired in improving the quality, reproducibility and preservability of an image formed, such as improvements in terms of three elements of color-brightness, chroma and tint-and improvements in reflection density, sharpness of edges, shape of dot, fixation of ink, water resistance and light resistance.

In the printer body two recovery means are arranged immediately below the groups of orifices 13*a*, 13*b* when the carriage 101 is at the home position. The recovery means has caps 103, 104 made of elastic member such as rubber and suction pumps 105, 106. The cap 103 and the suction pump 105 correspond to the group of orifices 13*a* and the cap 104 and the suction pump 106 corresponds to the group of orifices 13*b*.

The two caps 103, 104 are arranged vertically movable in FIG. 5.

Figure 6:
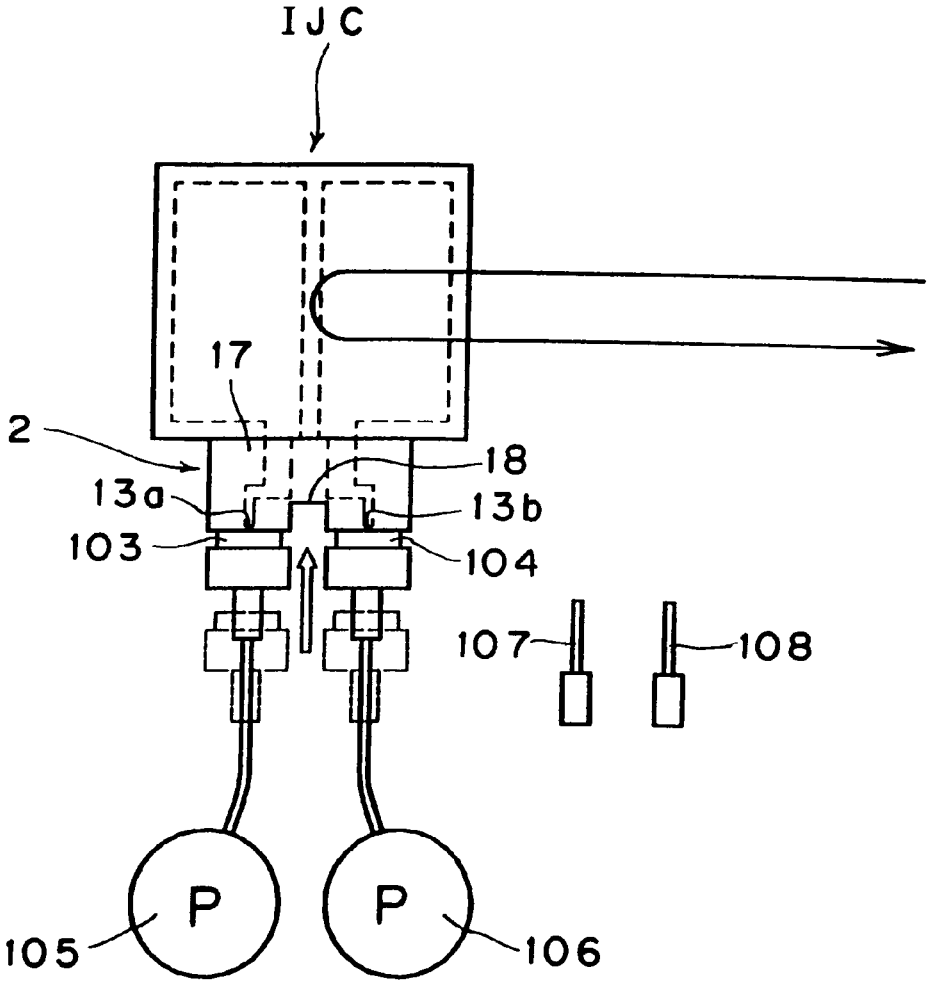
FIG. 6 is a schematic diagram showing a capping operation and a recovery operation performed on the print head mounted on the printer of FIG. 5.

FIG. 6 shows the recovery means as it performs the capping or recovery operation. When the carriage 101 is at the home position, the two caps 103, 104 are ready to move up from the retracted (lowered) position indicated by two-dot chain line. At the raised position indicated by solid line these caps 103, 104 are pressed against the areas of the orifices 13*a*, 13*b* of the ink-jet cartridge IJC, respectively. That is, in the capping action the caps 103, 104 surround with the elastic members the groups of the orifices 13*a*, 13*b* that are separated from each other by the liquid reservoir groove 18 formed in the top plate 17 of the ink-jet cartridge IJC and hermetically enclose the inner spaces.

With this capping operation, the orifices are kept from drying when the cartridge stands by during the print operation, thus preventing the ink and the print performance improving liquid from becoming viscous or solidifying around the orifices. The orifices are also protected from dust, eliminating abnormal ejection. Further, when an ejection failure occurs with the print head portion 2 or when such a trouble is expected, the above capping is performed and then the suction pumps 105, 106 are activated to apply a suction force to the capped spaces to draw out the ink and the print performance improving liquid from the orifices 13*a*, 13*b* (so-called recovery operation). This forces liquid with increased viscosity or solidified obstructive matters and bubbles present at the orifices or in the liquid passages inside the orifices to be drawn out of the orifices together with the ink and the print performance improving liquid, thus restoring the normal ejection or forestalling an ejection failure.

As shown in FIG. 5 to FIG. 8, the printer body is also provided with two wiping means which are parallelly arranged closer to the print area than the recovery means. The wiping means have blades 107, 108 made of elastic member such as rubber and their blade holders.

In this embodiment, as shown in FIGS. 7A, 7B, 8A, and 8B, the blade holders 107*a*, 108*a* are moved up and down by a blade raise/lower mechanism that is engageable with the carriage 101 and driven by the movement of the carriage 101. The blades 107, 108 can thus be set at a projected (raised) position where they wipe ink and foreign matters sticking to the orifice plate surface of the ink-jet cartridge IJC and at a retracted (lowered) position. (or standby position) where the blades do not contact the orifice plate surface. The mechanism is divided so that the blade 107 and the blade 108 can be raised or lowered independently of each other.

Figure 9:
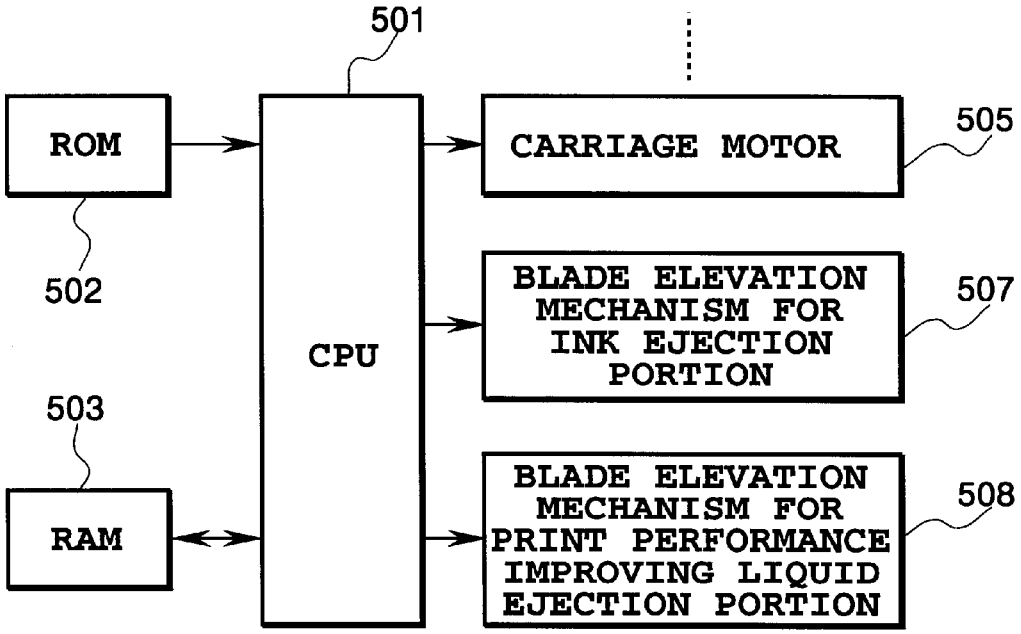
FIG. 9 is a block diagram showing the configuration of a main part of a printer control system to execute the operations shown in FIG. 7 and FIG. 8.

FIG. 9 shows an example configuration of a main part of the control system in the printer to perform appropriate wiping. Designated 501 is a CPU or main control unit to control various parts of the printer in performing print and recovery operations. Denoted 502 is a ROM that stores programs that correspond to various processing procedures executed by the CPU including the processing procedure of FIG. 10. Reference number 503 represents a RAM that provides predetermined data area and work area. A carriage motor 505 causes the carriage 101 to scan. Raise/lower mechanisms 507 and 508 raise or lower the ink orifice blade 107 and the print performance improving liquid orifice blade 108.

Figure 10:
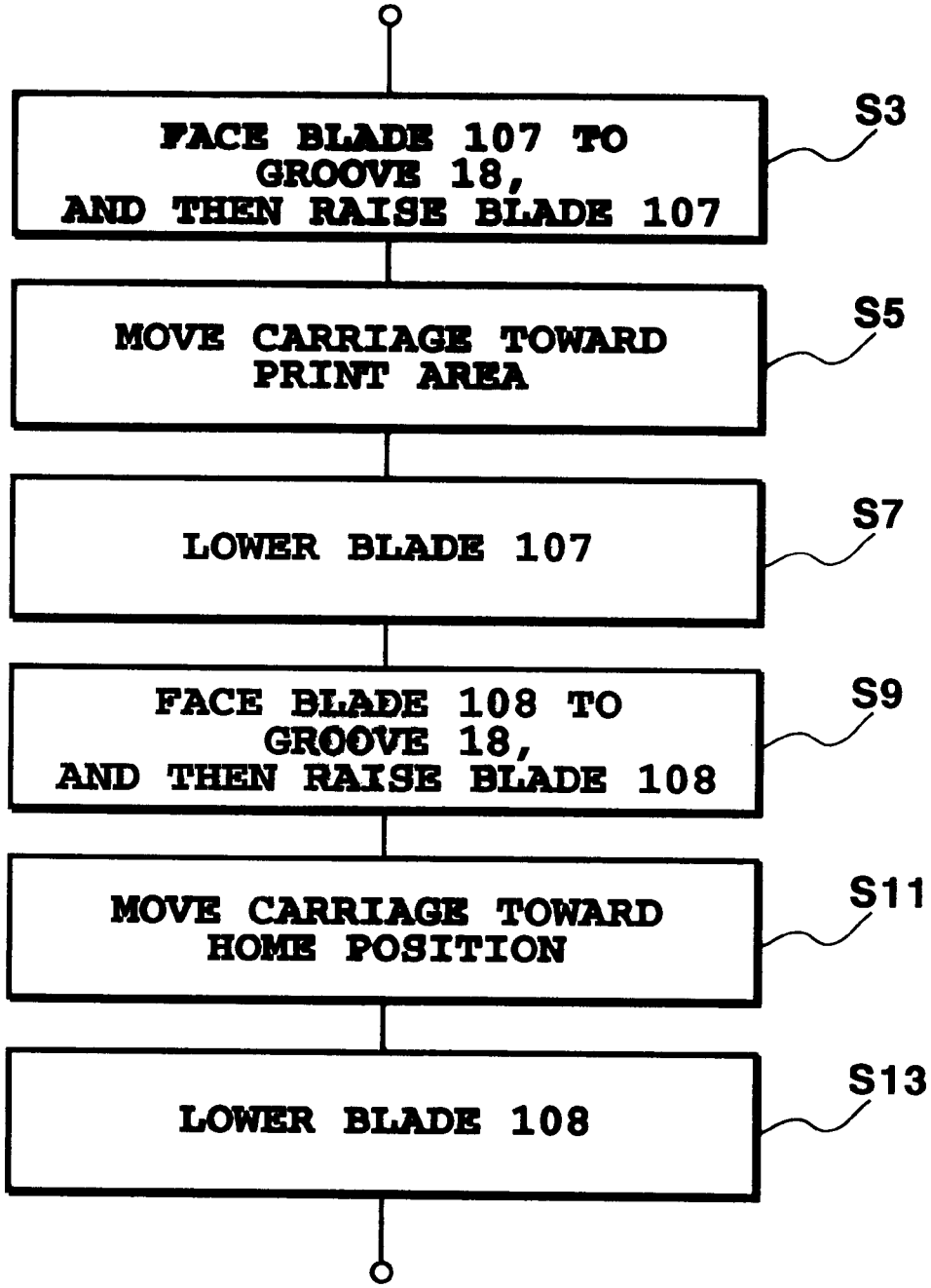
FIG. 10 is a flow chart showing an example processing procedure performed by the main part of the control system of FIG. 9.

FIG. 10 shows one example of the procedure to execute wiping. This procedure can be started at a desired timing.

Figure 7A:
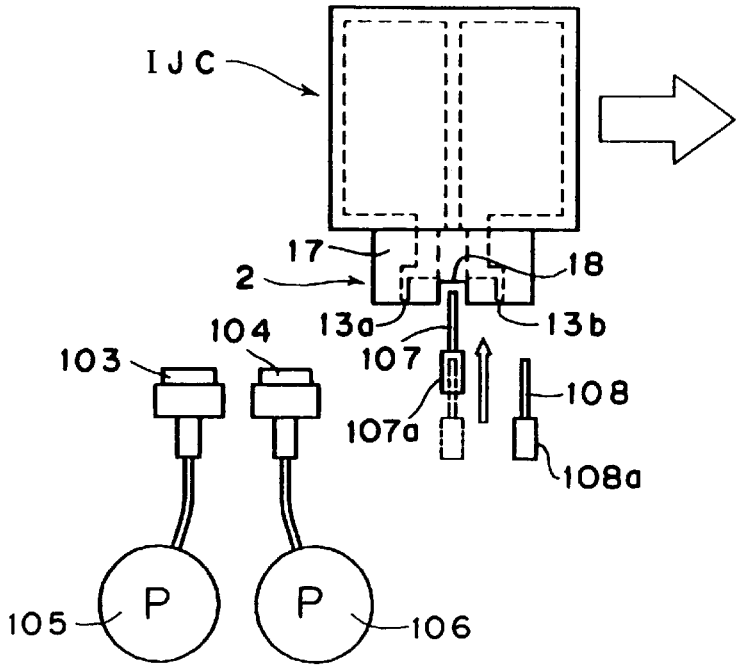
FIGS. 7A and 7B are schematic diagrams showing a wiping operation performed on the print ink orifices of the print head mounted in the printer of FIG. 5, FIG. 7A representing a state in which the wiping operation starts and FIG. 7B representing a state immediately before the wiping operation is finished.
Figure 7B:
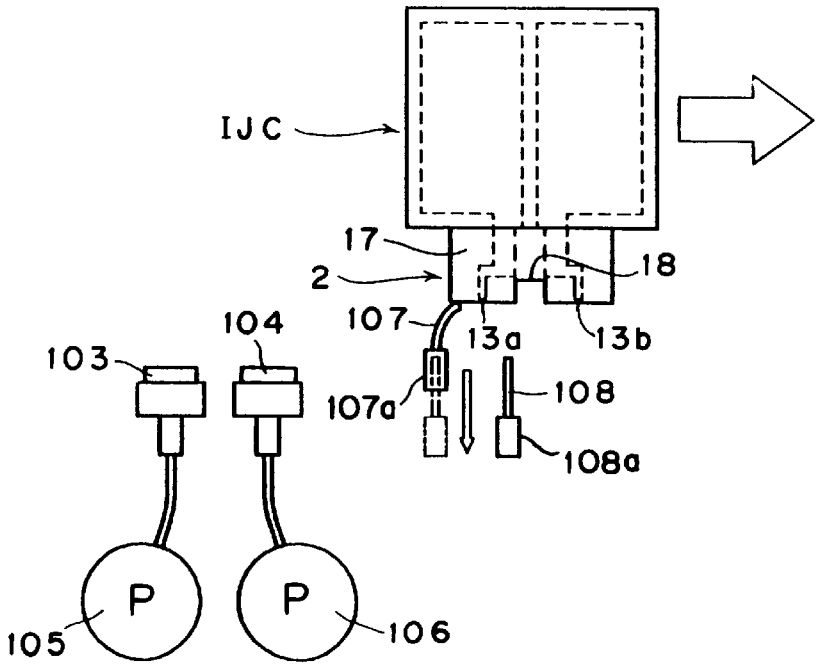

The operation of wiping the surface of the plate in which the print ink orifices 13*a* are formed will be explained, by referring to FIG. 7. After the blade 107 advances into the liquid reservoir groove 18 formed in the top plate 17 of the ink-jet cartridge IJC (step S3) as shown in FIG. 7A, the carriage 101 moves from the home position toward the print area (toward the right in the figure) (step S5), as shown in FIG. 7B. As a result, the blade 107 contacts the print ink orifices 13*a* to wipe their surface.

Figure 8A:
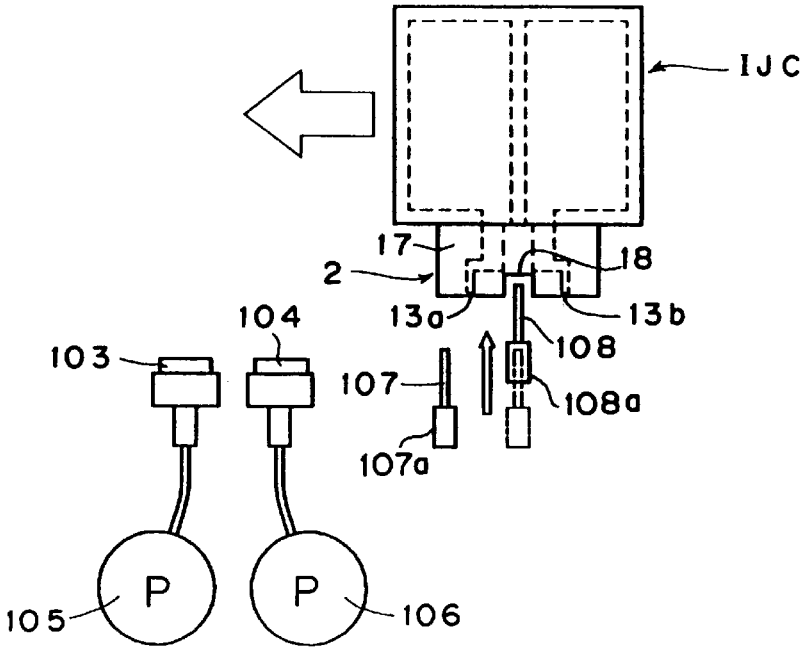
FIGS. 8A and 8B are schematic diagrams showing a wiping operation performed on the print performance improving liquid orifices of the print head mounted in the printer of FIG. 5, FIG. 8A representing a state in which the wiping operation starts and FIG. 8B representing a state immediately before the wiping operation is finished.
Figure 8B:
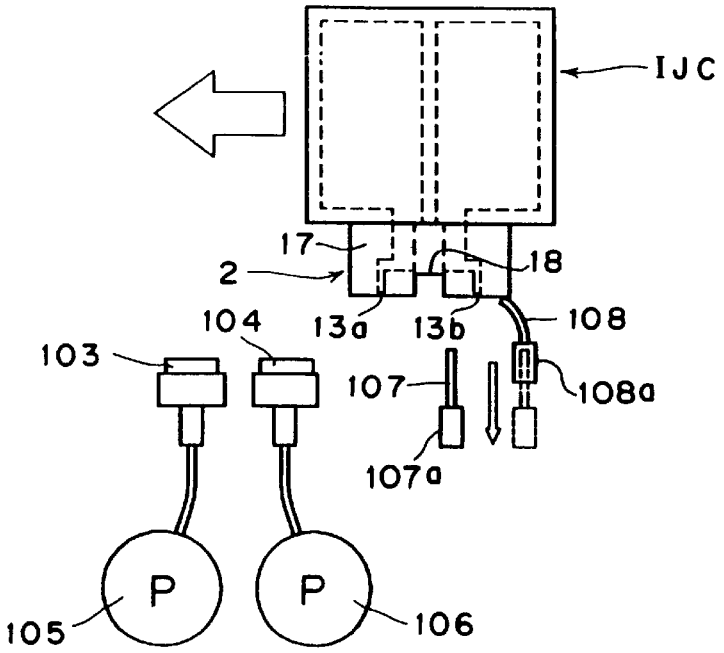

The operation of wiping the surface of the plate in which the print performance improving liquid orifices 13*b* are formed will be explained, by referring to FIG. 8. After the blade 108 advances into the liquid reservoir groove 18 formed in the top plate 17 of the ink-jet cartridge IJC (step S9) as shown in FIG. 8A, the carriage 101 moves from the print area side toward the home position (toward the left in the figure) (step S11), as shown in FIG. 8B. As a result, the:blade 108 contacts the print performance improving liquid orifices 13*b* to wipe their surface.

As described above, the control is carried out to use the blade 107 in wiping the print ink orifice surface and the blade 108 in wiping the print performance improving liquid orifice surface. When the wiping operation is finished, the blades 107, 108 are lowered to return to the standby position (step S7, S13). Performing the wiping in a direction away from the other group of orifices in this way can prevent liquid, if spattered by the snapping elastic blade, from adhering to the surface of the other group of orifices, which in turn prevents the mixing of the two liquids on the surface of the orifices.

Further, by first advancing the blades 107, 108 into the groove 18 and then bringing them into contact with the surface of the corresponding group of orifices for wiping as in this embodiment, it is possible to prevent the undesired spattering of liquid by blade deflection that occurs at the initial stage of blade contact when the surfaces of the both groups of orifices are arranged on the same continuous plane.

As described above, the print ink orifices and the print performance improving liquid orifices are provided with dedicated recovery caps (103 and 104) and dedicated blades (107 and 108) so that the two liquids can be independently handled. The two groups of orifices are also provided with independent dedicated suction pumps connected to the caps 103 and 104. This arrangement allows the ink and the print performance improving liquid-which aggregates the ink dyes and/or makes them insoluble-drawn out in the recovery operation to be handled properly and easily without the two liquids coming into contact with each other inside the caps 103, 104 and the suction pumps 105, 106. Further, during the wiping action of the blades this arrangement keeps the two liquids from mixing on the orifice surface. Thus, the ease of handling and reliability of the printer are improved.

Further, if one or both of the two liquids should leak before use (during transport, storage or marketing) or if, after the cartridge has been installed in the printer, the liquid should adhere to the orifice surface as a result of the recovery or wiping action activated for some reason, the liquid seeping along the orifice surface toward the other group of orifices can be effectively blocked because the surface of the ink orifices and the surface of the print performance improving liquid orifices are not situated on the same continuous plane but are separated by the liquid reservoir groove.

(Other Embodiments)

Figure 11:
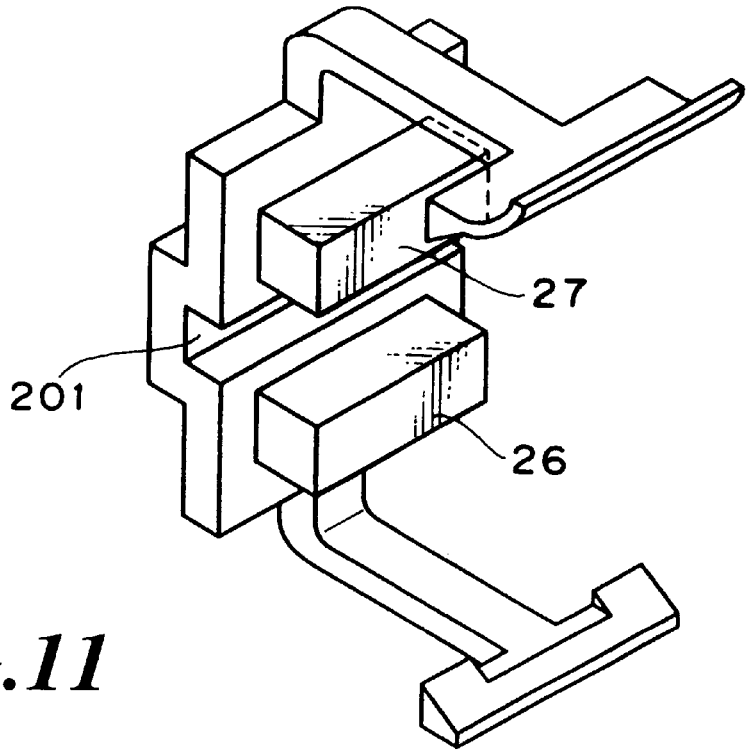
FIG. 11 is a perspective view of another embodiment of the protective cap.
Figure 12:
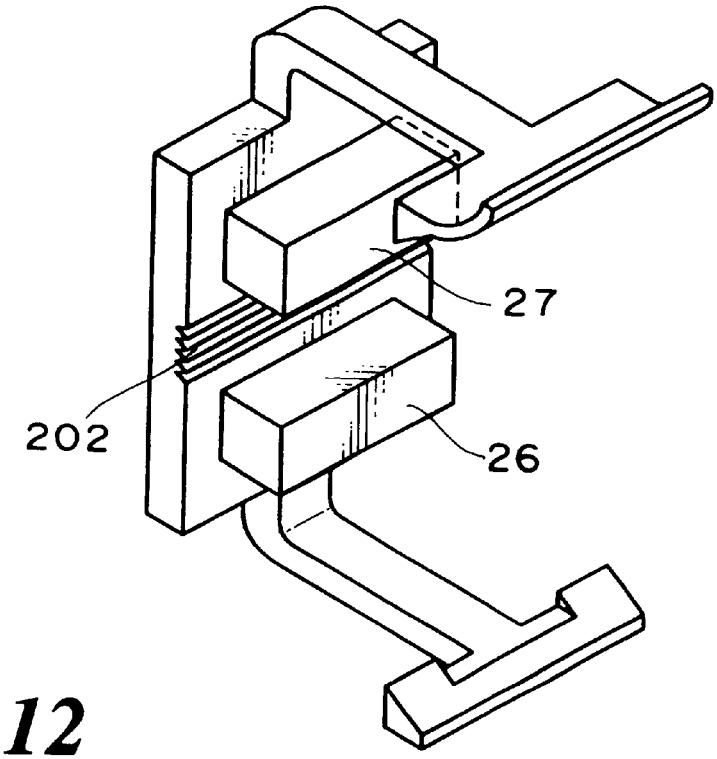
FIG. 12 is a perspective view of still another embodiment of the protective cap.
Figure 13:
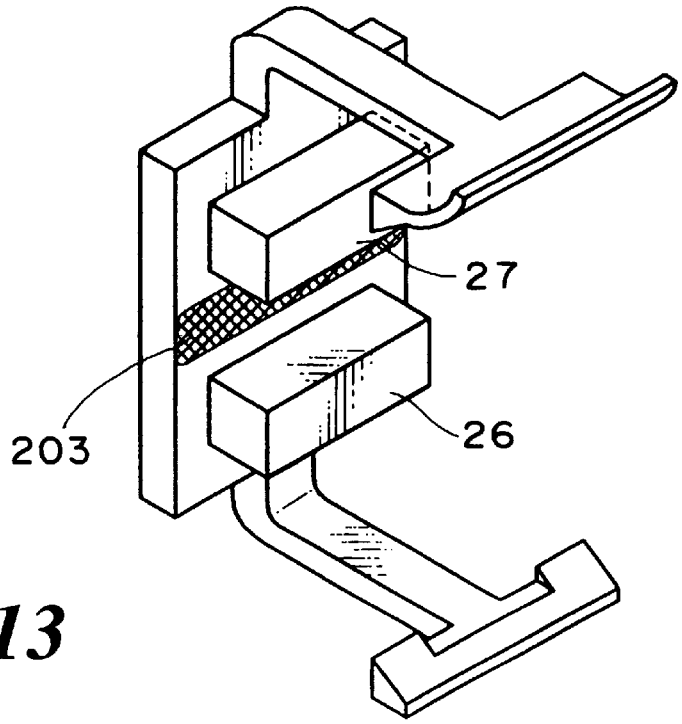
FIG. 13 is a perspective view of a further embodiment of the protective cap.

FIG. 11 to FIG. 13 represent other embodiments of the protective cap. These examples do not have the absorbent bodies 28, 29, the generally U-shaped wall of the protective cap enclosing the absorbent bodies, and the rib 32 arranged on the inner surface of the protective cap, all these employed in the first embodiment.

First, the protective cap shown in FIG. 11 has a groove 201 formed between and parallel to the two elastic bodies 26, 27. This construction increases the surface distance between the two elastic bodies 26, 27, as does the rib of the first embodiment, to block the leaking liquid that is seeping toward the other group of orifices.

The protective cap of FIG. 12 has a plurality of fine grooves 202 formed between and parallel to the two elastic bodies 26, 27. The liquid seeping toward the other group of orifices can be blocked by holding back the seeping liquid with the capillary action of the grooves, in the same way that the absorbent bodies of the first embodiment block the seeping liquid.

Further, the protective cap shown in FIG. 13 has a liquid-repelling part 203 between the two elastic bodies 26, 27. This repels the liquid seeping toward the other group of orifices and limits the direction of liquid movement, thus blocking the advance of the seeping liquid. Selection of an appropriate treatment of making the surface liquid-repellent in this embodiment can be made according to the composition of the print ink and the print performance improving liquid. The preferred liquid repellent is a fluoropolymer with an average molecular weight of 2000 or higher and with water insolubility and organic solvent solubility. Examples of the preferred liquid repellent include compounds having one or more reactive groups-selected from among polyperfluoromethacrylate, polyperfluoroacrylate, fluoroalkyl group, fluoroallyl group, fluorocycloslkyl group, fluoroalkali and fluoroalkylallyl group-and a silazane group, or siloxane-based polymers synthesized by the condensation of alkoxysilane monomer. Such repellents can be applied to the surface of the protective cap typically by spraying or transfer method.

In the ink-jet cartridge of the above construction, the orifices are pressed by the elastic bodies 26, 27 of the protective cap 4, preventing leakage of the ink and the print performance improving liquid. In the event that one or both of the liquids should leak, the liquid seeping toward the other group of orifices by the capillary action generated between the elastic body and the orifice surface (including capillary action generated at the contact surface of the protective tape 3 when the protective tape 3 is interposed as in this embodiment) can be blocked by forming independent pressing surfaces of the elastic bodies at each orifice group to cut off the capillary action. Further, because the liquid reservoir groove 201, the finely roughed surface 202 or the liquid-repelling surface 203 is provided between the elastic bodies, the liquid seeping toward the other orifice group can be blocked by the reservoir or by the extension of the surface distance that the leaking liquid must travel before it can reach the other orifice group.

Figure 14:
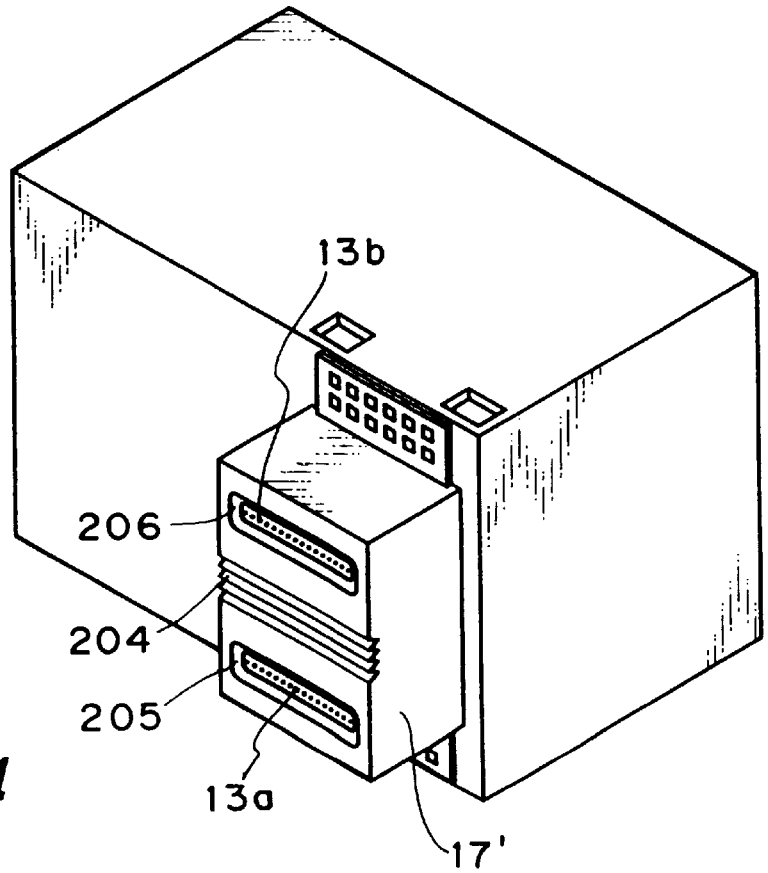
FIG. 14 is a perspective view of another embodiment of the print head.
Figure 15:
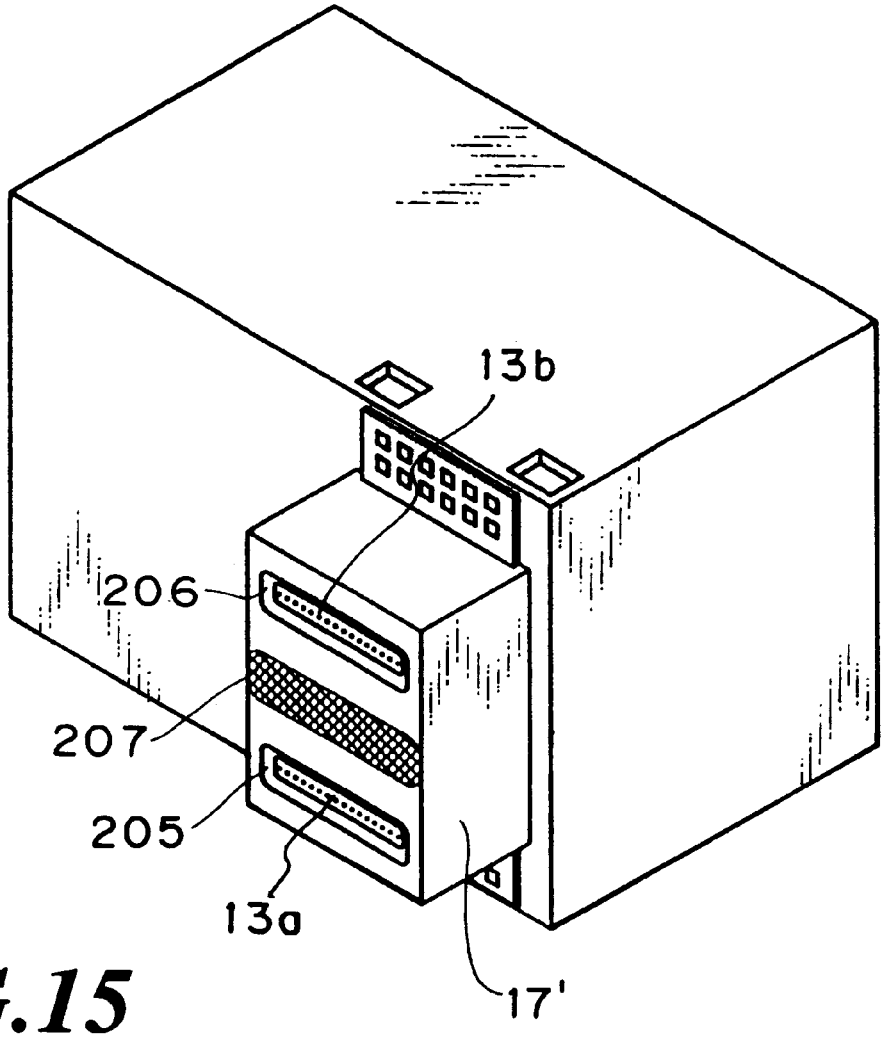
FIG. 15 is a perspective view of still another embodiment of the print head.
Figure 16:
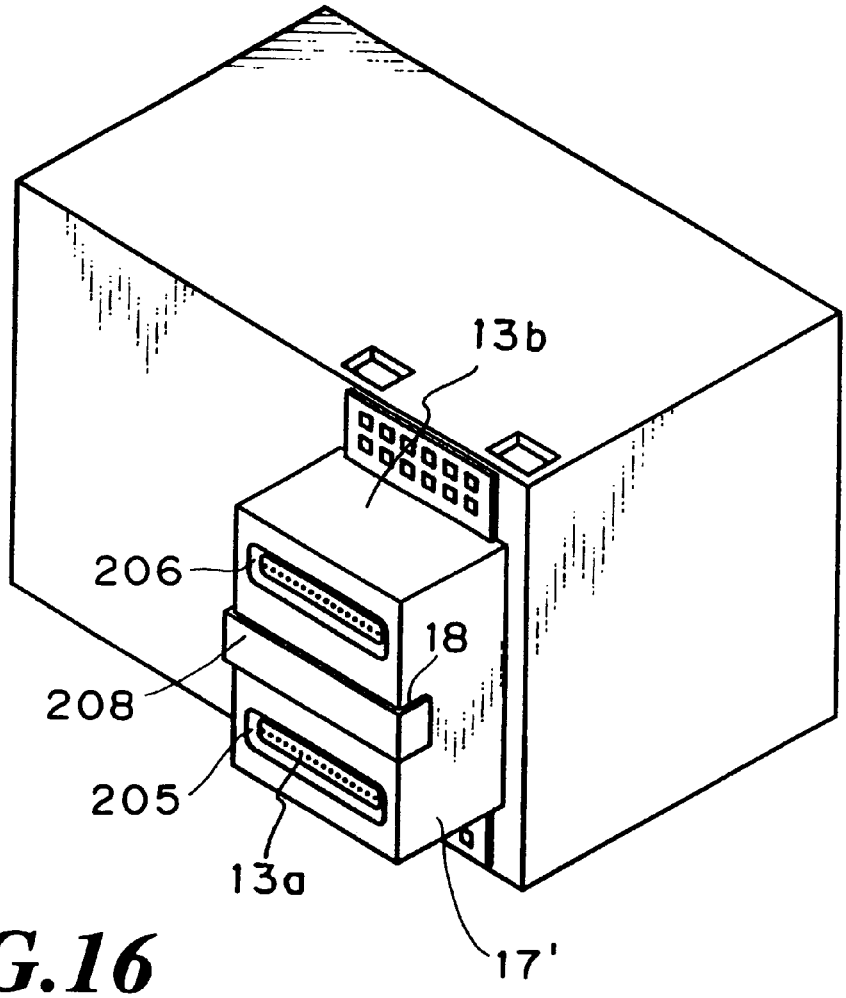
FIG. 16 is a perspective view of a further embodiment of the print head.

FIG. 14 to FIG. 16 represent further embodiments of the print head.

The print head portion shown in FIG. 14 has a plurality of fine grooves 204 formed between and parallel to the rows of two orifice groups 13*a*, 13*b* formed in the top plate 17'. Should a liquid leakage occur, this construction can block the liquid seeping toward the other orifice group by holding back the seeping liquid with the capillary action of the grooves.

The print head portion shown in FIG. 15 has a liquid-repelling part 207, instead of the grooves 18, formed between the rows of the two groups of orifices 13*a*, 13*b*. This repels the liquid seeping toward the other group of orifices and limits the direction of liquid movement, thus blocking the advance of the seeping liquid. The liquid-repelling treatment used in this embodiment can be performed in the same way as the aforementioned protective cap.

The print head portion shown in FIG. 16 has an absorbent body 208 of a porous material embedded in the groove 18 formed between the rows of the two orifice groups 13*a*, 13*b* formed in the top plate 17'. This construction blocks the advancement of the liquid seeping toward the other orifice group by absorbing and holding the liquid.

With the above print head, if one or both of the two liquids should leak before use (during transport, storage or marketing) or if, after the cartridge has been installed in the printer, the liquid should adhere to the orifice surface as a result of the recovery or wiping action activated for some reason, the liquid seeping along the orifice surface toward the other orifice group can be effectively blocked by the reservoir or by the extension of the surface distance that the leaking liquid must travel before it can reach the other orifice group, because the surface of the ink orifices and the surface of the print performance improving liquid orifices are not situated on the same continuous plane but are separated by the finely roughened surface 204, the liquid-repelling surface 207 or the absorbent member 208.

The surfaces of the orifice plates of the top plate 17' in which the orifices 13*a*, 13*b* are formed is not limited to those of the first embodiment but may use other configurations such as shown in FIGS. 14 to 16, in which small steps (205, 206) are formed.

Figure 18:
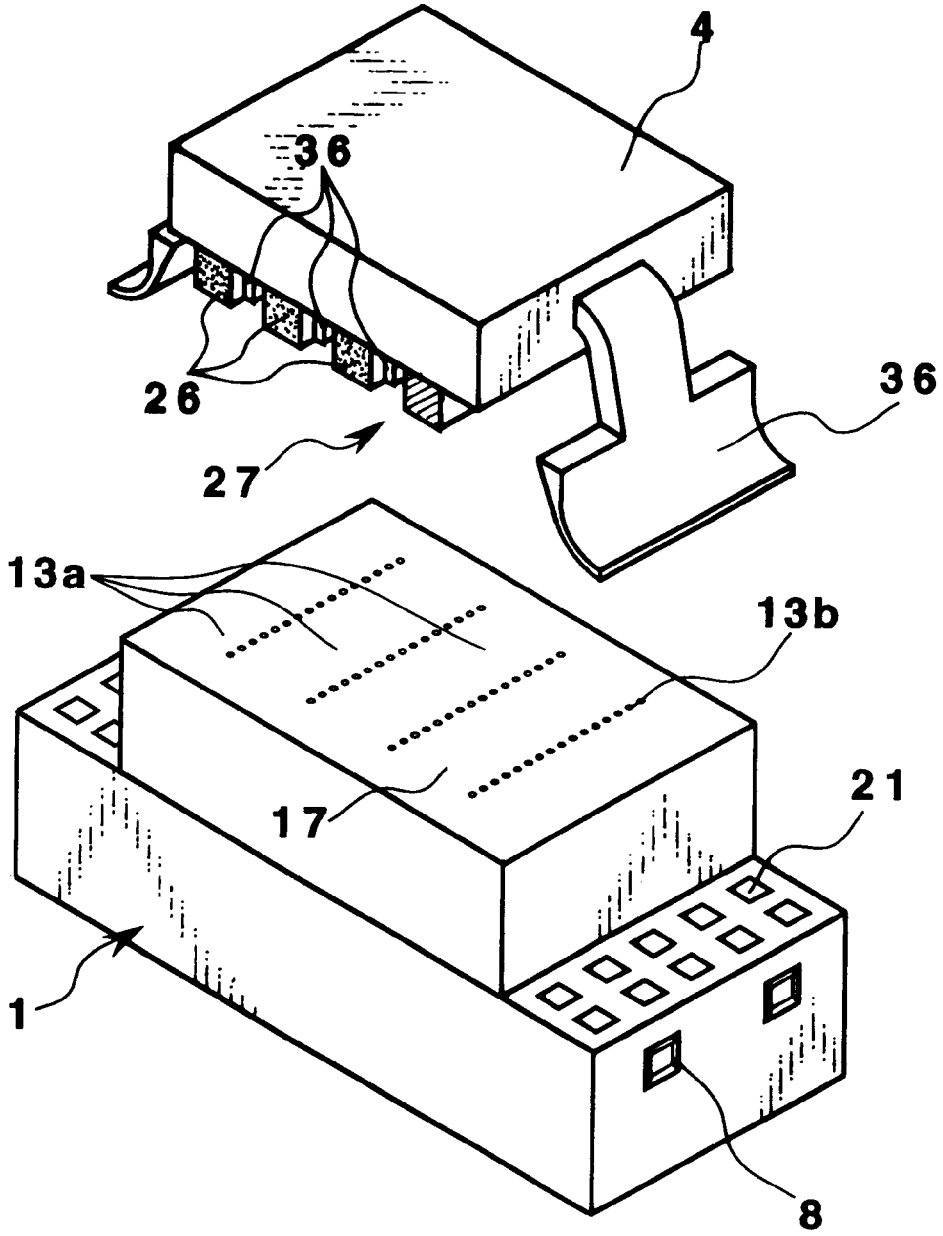
FIG. 18 is a perspective view showing a further embodiment of the protective cap and the print head.

Further, while the above embodiments have only one row of the ink orifices, we will explain about a protective cap for an ink-jet head which has three rows of ink orifices 13*a* and one row of print performance improving liquid orifices 13*b*, as shown in FIG. 18.

In FIG. 18, on the orifice plate there are three rows of ink orifices 13*a* and one row of print performance improving liquid orifices 13*b*, with the three ink orifice rows 13*a* adapted to eject yellow, cyan and magenta inks respectively.

It has been already discussed that the print performance improving liquid and the ink, when mixed, will become solidified. When three or more orifice rows are used as in this embodiment, the cap pressing state is likely to become uneven, increasing the risk of the print performance improving liquid and the inks coming into contact. This embodiment, therefore, employs a construction in which the elastic body 27 is made to press against the surface of the print performance improving liquid orifices 13*b*more firmly than other elastic bodies 26 so that, of the four rows of orifices, only the print performance improving liquid orifices 13*b* are securely closed. This construction enables the print performance improving liquid to be reliably sealed. If different inks (in this case, inks ejected from the three rows of nozzles 13*a*) should mix, no problem arises, such as solidifying of inks, and the only problem of color mixing can be solved to some extent by performing the recovery operation. The pressing state described above can be achieved by setting the height of the elastic body 27 larger than those of the other elastic bodies or by setting the hardness of the elastic body 27 higher than those of the other elastic bodies 26.

When the pH of the print performance improving liquid is at around 5 or 6 exhibiting acidity, the elastic body 27 that presses against the print performance improving liquid orifices can be formed of an acid-resistant material. For example, when the elastic bodies 26 are made of polyurethane elastomer porous material, the elastic body 27 may use a silicone rubber foam with excellent acid resistance, instead of the polyurethane elastomer porous material.

Further, between these elastic bodies 26, 27, which correspond to the rows of orifices, there are provided ribs 32 whose heights are lower than those of the elastic bodies when elastically deformed, in order to prevent contact among the elastic bodies as may be caused by the deflection of the elastic bodies and to ensure that the elastic bodies can realize their appropriate pressing condition.

Figure 17:
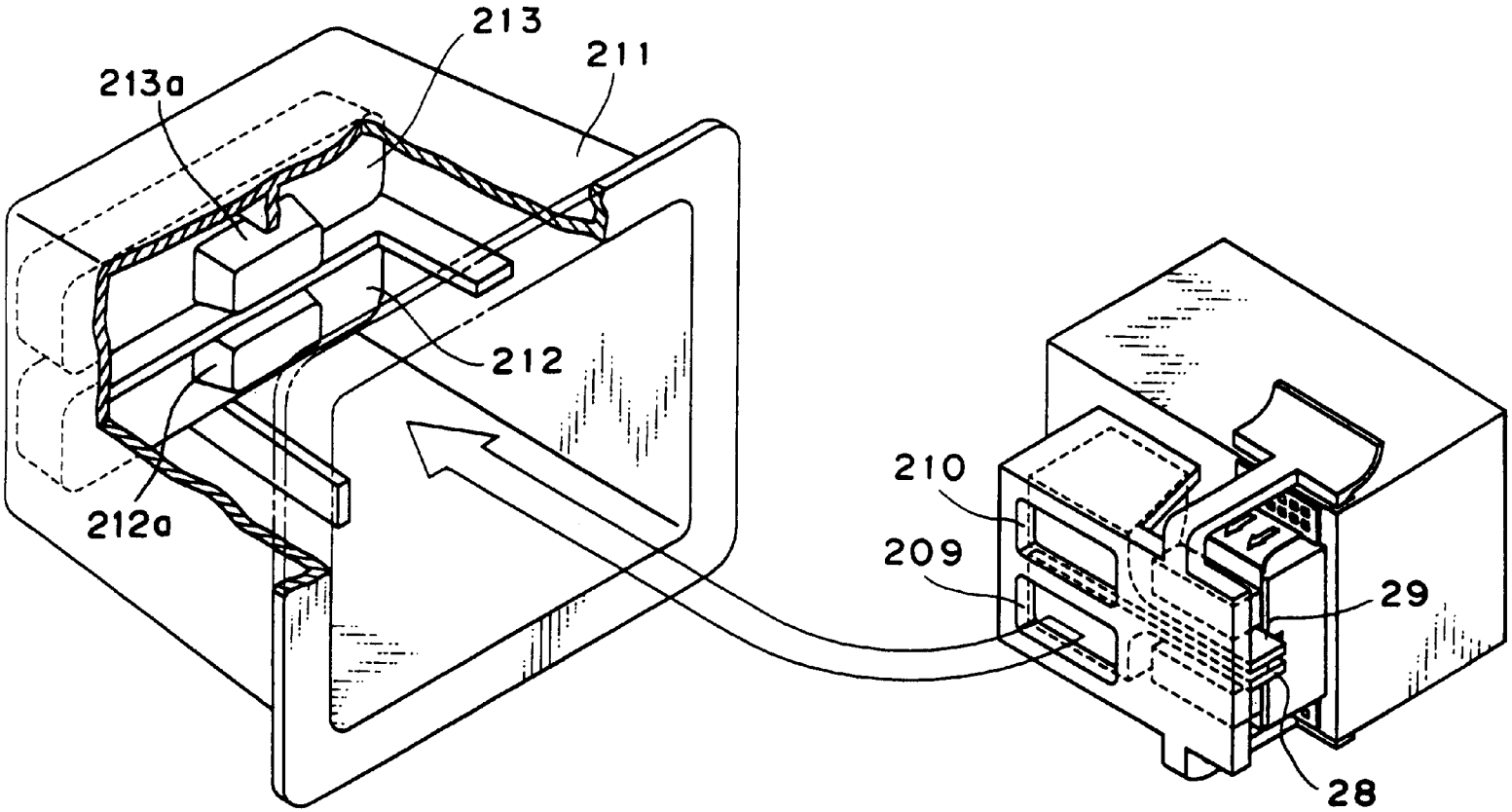
FIG. 17 is a perspective view showing another embodiment of the ink-jet cartridge and a transport container thereof.

In the ink-jet cartridge IJC of FIG. 17, the protective cap of the first embodiment is provided with holes 209, 210 that expose the absorbent bodies 28, 29—which soak the leaking liquid-to the outside of the cap and communicate the leaking liquid to the outside. A container 211 accommodating the ink-jet cartridge IJC during transport has ribs inside, by the side of which second absorbent bodies 212, 213 are formed. The ribs support the ink-jet cartridge IJC and also isolate the two absorbent bodies 212, 213 from each other. The two absorbent bodies 212, 213 are formed with the projected portions 212*a*, 213*a* that, when the ink-jet cartridge IJC is received in the container 211, fit into the holes 209, 210 of the protective cap to engage with the absorbent bodies 28, 29 of the protective cap.

With the ink-jet cartridge IJC and the transport container shown in FIG. 17, the amount of liquid that can be retained in the absorbent bodies 28, 29 provided in the protective cap of the first embodiment can be compensated for. Hence, if a large amount of liquid should leak out, the arrangement inside the transport container 211 can prevent contact between the print ink and the print performance improving liquid that aggregates and/or makes insoluble the dyes in the inks and thereby enhance reliability.

The present invention is not limited to the configurations of the above embodiments and any desired modifications may be made. For example, it is possible to combine the above configurations of the sealing member (protective tape), the orifice pressing member (protective cap) and the print head, or to adopt a configuration in which a means for blocking the advance of the seeping liquid between the groups of orifices is added to only a part of these three members. In other words, the protective cap and/or the print head use one of the above configurations and, if this configuration can block the liquid advancement well, the protective tape 3 may not be formed with the opening 23.

Although the present invention is applicable to a print head, an ink jet cartridge, an ink-jet recording (printing) apparatus which utilize electromechanical transducers and the like, the present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 μm in pore size (tradename: fuloropore filter manufactured by Sumitomo Electric Industries, Ltd.), and thereafter, pH of the mixture is adjusted to a level of 4.8 by adding sodium hydroxide whereby liquid A1 can be obtained.

[Components of A1]

| | |
|---|---|
| low molecular weight ingredients of cationic compound; stearyl-trimethyl ammonium salts (tradename: Electrostriper QE, manufactured by Kao Corporation), or stearyl-trimethyl ammonium chloride (tradename: Yutamine 86P, manufactured by Kao Corporation) | 2.0 parts by weight |
| high molecular weight ingredients of cationic compound; copolymer of diarylamine hydrochloride and sulfur dioxide (having an average molecular weight of 5000) (tradename: polyaminesulfon PAS-92, manufactured by Nitto Boseki Co., Ltd) | 3.0 parts by weight |
| thiodiglycol | 10 parts by weight |
| water | balance |

Preferable examples of ink which becomes insoluble by mixing the aforementioned processing liquid can be noted below.

Specifically, the following components are mixed together, the resultant mixture is pressure-filtered with the use of a membrane filter of 0.22 μm in pore size (tradename:Fuloroporefilter, manufactured by Sumitomo Electric Industries, Ltd.) so that yellow ink Y1, magenta ink M1, cyan ink C1 and black ink K1 can be obtained.

[Yellow Ink Y1]

| | |
|---|---|
| C. I. direct yellow 142 | 2 parts by weight |
| thiodiglycol | 10 parts by weight |
| acetynol EH (tradename manufactured by Kawaken Fine Chemical Co., Ltd.) | 0.05 parts by weight |
| water | balance |

[Magenta Ink M1]

having the same composition as that of Y1 other than that the dyestuff is changed to 2.5 parts by weight of C. I. acid red 289.

[Cyan ink C1]

having the same composition as that of Y1 other than that the dyestuff is changed to 2.5 parts by weight of acid blue 9.

[Black ink K1]

having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black Ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average molecular weight of 6000, neutralizing agent: potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

(Composition of Carbon Black Dispersing Element)

| | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10 %.

[Yellow Ink Y2]

Anionic high molecular P-2 (aqueous solution containing a solid ingredient of 20% of stylen-acrlylic acid methyl methaacrylate having an acid value of 280 and an average molecular weight of 11,000, neutralizing agent:diethanolamine) is used as a dispersing agent and dispersive treatment is conducted in the same manner as production of the black ink K2 whereby yellow color dispersing element having a weight-average grain size of 103 nm is produced.

(Composition of Yellow Dispersing Element)

| | |
|---|---|
| P-2 aqueous solution (having a solid ingredient of 20%) | 35 parts |
| C. I. pigment yellow 180 (tradename: Nobapalm yellow PH-G, manufactured by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan Ink C2]

Cyan colored-dispersant element having a weight-average grain size of 120 nm is produced by using the anionic high molecular P-1 used when producing the black ink K2 as dispersing agent, and moreover, using the following materials by conducting dispersing treatment in the same manner as the carbon black dispersing element.

(Composition of Cyan Colored-dispersing Element)

| | |
|---|---|
| P-1 aqueous solution (having solid ingredient of 20%) | 30 parts |
| C. I. pigment blue 153 (tradename: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta Ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

(Composition of the Magenta Colored Dispersing Element)

| | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

It should be noted that the kind of the printing medium is not specified in implementation of the present invention, and conventionally used plain paper, such as copy paper, bond paper and so forth can be suitably used. Of course, a coated paper specially prepared for ink-jet printing, transparent film for OHP and so forth may also be used suitably. Also, general wood free paper, glossy paper and so forth may also used suitably.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As explained above, if an ink or a print performance improving liquid should leak from orifices when the printer is not in use, for example during transport, storage or marketing, this invention can prevent the dyes (coloring material) from becoming insoluble or aggregating at around the orifices, thus maintaining high image quality during use. Further, although the individual sealing surfaces of the protective tape (sealing member) and the individual pressing surfaces of the protective caps (orifice pressing members) for at least two groups of orifices are independent of each other, the ink-jet cartridge can be mounted to or dismounted from the printer with a single action, maintaining the high level of ease of handling.

Further, not only does this invention prevent the ink and the print performance improving liquid from mixing should these liquids leak from the orifices during transport, storage or marketing, but the invention also prevents the both liquids from mixing at around the print head orifices and thereby prevents the dyes (coloring material) from becoming insoluble or aggregating when, after the cartridge is installed in the printer body, the liquids are spattered or the recovery and wiping operations are performed. This maintains high print quality during use.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet cartridge, comprising:

a print head portion having a first ejection portion to eject print ink and a second ejection portion to eject liquid containing print performance improving liquid to improve the print performance of the print ink ejected from said first ejection portion by mixing with the print ink and causing the print ink to aggregate or become insoluble, said print head portion being able to be mounted in an ink-jet print apparatus; and a seal member removably bonded to said print head portion and having an opening through a portion thereof, said seal member closing said first ejection portion and said second ejection portion so that said opening through said seal member is positioned between said first and second ejection portions.

2. An ink-jet cartridge, comprising:

a print head portion having a first ejection portion to eject print ink and a second ejection portion to eject liquid containing print performance improving liquid to improve the print performance of the print ink ejected from said first ejection portion by mixing with the print ink and causing the print ink to aggregate or become insoluble, said print head portion being able to be mounted in an ink-jet print apparatus; and an ejection portion pressing member removably mounted on said print head portion, said ejection portion pressing member having first and second separate elastic members, said first and second separate elastic members being positioned on said ejection portion pressing member with a gap therebetween so as to form independent pressing surfaces to press said first and second ejection portions, respectively.

3. An ink-jet cartridge as claimed in claim 2, wherein said ejection portion pressing member presses said first and second ejection portions through a seal member that closes said first and second ejection portions.

4. An ink-jet cartridge as claimed in claim 3, wherein said seal member has an opening between a portion closing said first ejection portion and a portion closing said second ejection portion.

5. An ink-jet cartridge as claimed in claim 2, wherein said first and second elastic members are formed of a porous body.

6. An ink-jet cartridge as claimed in claim 5, wherein a pressing surface of at least one of said first and second elastic members has a smooth skin layer.

7. An ink-jet cartridge as claimed in claim 2, wherein a pressing force of said second elastic member is greater than a pressing force of said first elastic member.

8. An ink-jet cartridge as claimed in claim 7, wherein a dimension of said second elastic member in a pressing direction is set larger than a dimension of said first elastic member in the pressing direction to differentiate pressing forces of said first elastic member and said second elastic member.

9. An ink-jet cartridge as claimed in claim 7, wherein said second elastic member uses a material with a higher hardness than that of a material of said first elastic member to differentiate pressing forces of said first elastic member and said second elastic member.

10. An ink-jet cartridge as claimed in claim 2, wherein a rib is provided between said first elastic member and said second elastic member, the rib having a height lower than the heights of said first and second elastic members when elastically deformed.

11. An ink-jet cartridge as claimed in claim 2, wherein said second elastic member is made of a material with excellent acid resistance.

12. An ink-jet cartridge as claimed in claim 2, wherein said ejection portion pressing member has a holding member that holds said first and second elastic members and keeps said first and second elastic members in an elastically deformed state produced by a pressing action, and said holding member is provided with means, at a position between said first and second elastic members, for preventing liquid from at least one of said first and second ejection portions reaching the other ejection portion.

13. An ink-jet cartridge as claimed in claim 12, wherein said reach preventing means comprises a rib to isolate said first and second elastic members from each other.

14. An ink-jet cartridge as claimed in claim 12, wherein said reach preventing means comprises a groove or a finely roughened surface formed on said holding member between said first and second elastic members.

15. An ink-jet cartridge as claimed in claim 12, wherein said reach preventing means comprises a liquid-repellent surface applied on said holding member between said first and second elastic members.

16. An ink-jet cartridge as claimed in claim 12, wherein said reach preventing means comprises a liquid-absorbent member provided on said holding member between the first and second elastic members.

17. A method of storing a print head having a first ejection portion to eject print ink and a second ejection portion to eject liquid containing print performance improving liquid to improve the print performance of the print ink ejected from said first ejection portion by mixing with the print ink and causing the print ink to aggregate or become insoluble, said print head being able to be mounted in an ink-jet print apparatus, comprising the step of:

hermetically closing said first and second ejection portions with first and second separate elastic members of an ejection portion pressing member, the first and second separate elastic members being positioned on the ejection portion pressing member with a gap therebetween so as to form independent pressing surfaces.

18. A method of storing a print head as claimed in claim 17, wherein the ejection portion pressing member presses said first and second ejection portions through a seal member that closes said first and second ejection portions.

19. A method of storing a print head as claimed in claim 18, wherein said seal member has an opening between a portion closing the first ejection portion and a portion closing the second ejection portion.

20. A method of storing a print head as claimed in claim 17, wherein said first and second elastic members are formed of a porous body.

21. A method of storing a print head as claimed in claim 20, wherein a pressing surface of at least one of said first and second elastic members has a smooth skin layer.

22. A method of storing a print head as claimed in claim 20, wherein a pressing force of said second elastic member is greater than a pressing force of said first elastic member.

23. A method of storing a print head as claimed in claim 22, wherein a dimension of said second elastic member in a pressing direction is set larger than a dimension of said first elastic member in the pressing direction to differentiate pressing forces of said first elastic member and said second elastic member.

24. A method of storing a print head as claimed in claims 22, wherein said second elastic member uses a material with a higher hardness than that of a material of said first elastic member to differentiate pressing forces of said first elastic member and said second elastic member.

25. A method of storing a print head as claimed in claim 17, wherein a rib is provided between said first elastic member and said second elastic member, the rib having a height lower than the heights of said first and second elastic members when elastically deformed.

26. A method of storing a print head as claimed in claim 17, wherein said second elastic member is made of a material with excellent acid resistance.

27. A method of storing a print head as claimed in claim 17, wherein said ejection portion pressing member has a holding member that holds said first and second elastic members and keeps said first and second elastic members in an elastically deformed state produced by a pressing action, and said holding member is provided with means, at a position between said first and second elastic members, for preventing liquid from at least one of said first and second ejection portions reaching the other ejection portion.

28. A method of storing a print head as claimed in claim 27, wherein said reach preventing means comprises a rib to isolate said first and second elastic members from each other.

29. A method of storing a print head as claimed in claim 27, wherein said reach preventing means comprises a groove or a finely roughened surface formed on said holding member between said first and second elastic members.

30. A method of storing a print head as claimed in claim 27, wherein said reach preventing means comprises a liquid-repellent surface applied on said holding member between said first and second elastic members.

31. A method of storing a print head as claimed in claim 27, wherein said reach preventing means comprise a liquid-absorbent member provided on said holding member between the first and second elastic members.

* * * * *

UNITED STATES PATENT AND TRADEMARK OFFICE

CERTIFICATE OF CORRECTION

PATENT NO. : 6,409,325 B1
DATED : June 25, 2002
INVENTOR(S) : Toshiya Matsumoto et al.

It is certified that error appears in the above-identified patent and that said Letters Patent is hereby corrected as shown below:

Column 2,
Line 7, “scanning,” should read -- scanning --;
Line 14, “colors-yellow (Y),” should read -- colors yellow (Y) --;
Line 15, “cyan (C) - or” should read -- cyan (C) or --;
Line 35, “:formed.” should read -- formed. --.

Column 3,
Line 34, “rises” should read -- rise --.

Column 9,
Line 10, “spaced” should read -- spaced at --;
Line 45, “thick-a” should read -- thick—a --.

Column 10,
Line 28, “(hat shown)” should read -- (not shown) --.

Column 12,
Line 12, “the: blade” should read -- the blade --;
Line 40, “liquid-which” should read -- liquid which --;
Line 41, “insoluble-drawn” should read -- insoluble drawn --.

Column 13,
Line 24, “groups-selected” should read -- groups selected --.
Line 26, “fluorocycloslkyl” should read -- fluorocycloalkyl --.

Column 14,
Line 43, “13bmore” should read -- 13b more --.

Column 15,
Line 8, “liquid-to” should read -- liquid to --.

Column 19,
Line 17, “stylen-acrlylic” should read -- styrene-acrylic --.

Column 20,
Line 25, “also” should read -- also be --.

UNITED STATES PATENT AND TRADEMARK OFFICE

CERTIFICATE OF CORRECTION

PATENT NO. : 6,409,325 B1
DATED : June 25, 2002
INVENTOR(S) : Toshiya Matsumoto et al.

It is certified that error appears in the above-identified patent and that said Letters Patent is hereby corrected as shown below:

Column 22,
Line 60, "claims" should read -- claim --.

Column 24,
Line 12, "comprise" should read -- comprises --.

Signed and Sealed this

First Day of April, 2003

JAMES E. ROGAN
*Director of the United States Patent and Trademark Office*